US010476148B2

(12) United States Patent
Navarro

(10) Patent No.: US 10,476,148 B2
(45) Date of Patent: Nov. 12, 2019

(54) ANTENNA INTEGRATED PRINTED WIRING BOARD (AIPWB)

(71) Applicant: The Boeing Company, Chicago, IL (US)

(72) Inventor: Julio Angel Navarro, Kent, WA (US)

(73) Assignee: The Boeing Company, Chicago, IL (US)

( * ) Notice: Subject to any disclaimer, the term of this patent is extended or adjusted under 35 U.S.C. 154(b) by 112 days.

(21) Appl. No.: 15/693,259

(22) Filed: Aug. 31, 2017

(65) Prior Publication Data

US 2018/0358691 A1 Dec. 13, 2018

Related U.S. Application Data

(60) Provisional application No. 62/516,613, filed on Jun. 7, 2017.

(51) Int. Cl.

| | |
|---|---|
| ***H01Q 1/12*** | (2006.01) |
| ***H01Q 1/38*** | (2006.01) |
| ***H01Q 21/22*** | (2006.01) |
| ***H01Q 3/34*** | (2006.01) |
| ***H01Q 21/00*** | (2006.01) |
| ***H01Q 21/06*** | (2006.01) |

(52) U.S. Cl.
CPC ..... *H01Q 1/38* (2013.01); *H01Q 3/34* (2013.01); *H01Q 21/0025* (2013.01); *H01Q 21/0087* (2013.01); *H01Q 21/061* (2013.01); *H01Q 21/22* (2013.01)

(58) Field of Classification Search
CPC ..... H01Q 1/38; H01Q 3/34; H01Q 21/0025; H01Q 21/0087; H01Q 21/22
USPC ..... 343/878
See application file for complete search history.

(56) References Cited

U.S. PATENT DOCUMENTS

| | | | | |
|---|---|---|---|---|
| 5,886,671 | A * | 3/1999 | Riemer | H01Q 1/28 342/368 |
| 6,670,930 | B2 | 12/2003 | Navarro | |
| 6,989,791 | B2 * | 1/2006 | Navarro | H01O 21/0093 343/700 MS |
| 7,289,078 | B2 | 10/2007 | Navarro | |
| 7,388,756 | B1 | 6/2008 | Worl et al. | |
| 7,889,135 | B2 * | 2/2011 | Blaser | H01O 21/064 343/700 MS |
| 2009/0284415 | A1 | 11/2009 | Worl et al. | |
| 2010/0066631 | A1 * | 3/2010 | Puzella | H01Q 1/02 343/853 |
| 2010/0194640 | A1 * | 8/2010 | Navarro | G01S 7/006 342/372 |
| 2016/0172755 | A1 | 6/2016 | Chen et al. | |

OTHER PUBLICATIONS

European Search Report dated Oct. 29, 2018 in corresponding EP Application No. 18176060.4, 7 pgs.

* cited by examiner

*Primary Examiner* — Huedung X Mancuso
(74) *Attorney, Agent, or Firm* — Toler Law Group, PC

(57) ABSTRACT

Disclosed is an improved antenna integrated printed wiring board ("IAiPWB"). The IAiPWB includes a printed wiring board ("PWB"), a first radiating element, and a first split-via. The PWB has a bottom surface and the first radiating element is integrated into the PWB. The first radiating element has a first radiator. The first probe is in signal communication with the first radiator and the first split-via, where a portion of the first split-via is integrated into the PWB at the bottom surface.

22 Claims, 24 Drawing Sheets

ANTENNA INTEGRATED PRINTED WIRING BOARD (AIPWB)

CROSS-REFERENCE To RELATED APPLICATION AND CLAIM OF PRIORITY

The present patent application claims priority under 35 U.S.C. § 119(e) to earlier filed U.S. provisional patent application No. 62/516,613, filed on Jun. 7, 2017, and titled "Phased Array Antenna Integrated Printed Wiring Board (AIPWB) Having Split-Vias," which is hereby incorporated by reference in its entirety.

BACKGROUND

1. Field

The present disclosure is related to antennas, and more specifically, to integrated antennas on a printed wiring board ("PWB").

2. Related Art

Phased-array antennas are constructed by arranging many, even thousands, of radiating elements spaced in a plane. In operation, the output of each radiating element is controlled electronically. The superposition of the phase-controlled signals from the radiating elements causes a beam pattern that can be steered without any physical movement of the antenna. In one type of phased-array antenna, known as an active-array antenna, each radiating element has associated with it electronics that include amplifiers and phase shifters. In general, the distributed nature of an active-array antenna architecture offers advantages in, for example, power management, reliability, system performance and signal reception and/or transmission. However, the electronics associated with the radiating elements typically cause the active-array antenna to be much thicker than a passive-array antenna. Additionally, at present, active-array antennas at microwave and higher frequencies have had limited use due to their high cost and due to difficulties of integrating the required electronics, radiating structures, and radio frequencies ("RF"), direct current ("DC"), and logic distribution networks particularly at frequencies higher than 10 GHz.

Generally, the spacing required between radiating elements (i.e., inter-element spacing) for active-array antennas that must steer over wide scan angles (for example, over a positive 60 degrees to a negative 60 degrees) is on the order of ½ a wavelength of the center frequency of operation. The receive electronics or transmit electronics for each radiating element must be installed within the projected area corresponding to the inter-element spacing. In the case of a radar, both the receive and transmit electronics must occupy this limited space.

A known approach to designing phased-array antennas with limited space includes the utilization of a three-dimensional ("3-D") packaging architecture that includes phased-array antenna (or a portion of a phased-array antenna) integrated into a signal component known as an antenna integrated printed wiring board ("AiPWB") and a brick-style compact phase-array antenna module ("brick module") to house the electronics to drive and control the radiating elements in the AiPWB. This approach utilizes one or more vertically oriented brick modules to house the electronics, chip carrier(s), and distribution networks. The approach allows utilizes a horizontally orientated AiPWB. The vertically orientation of the brick module allows for proper lattice spacing of the radiating elements of the phased-array antenna for a given operating frequency. Examples of this approach are described in U.S. Pat. No. 7,289,078, titled "Millimeter Wave Antenna," issued Oct. 30, 2007, to J. A. Navarro and U.S. Pat. No. 7,388,756, titled "Method and System for Angled RF connection Using Flexible Substrate," issued Jun. 17, 2008, to Worl et al., both of which are assigned to The Boeing Company, of Chicago, Ill. and which are both herein incorporated by reference in their entirety.

These known approaches utilize electrical connections that connect the vertical assembly (i.e., the brick module) to the horizontal assembly (i.e., the AiPWB), where the electrical connections need to bend approximately 90 degrees between the attachment points on the vertical and horizontal assemblies.

For example, in FIG. 1, a conventional interconnect configuration 100 connecting a brick module 102 with an AiPWB 104 via a bond wire 106 is shown utilizing manually formed wire bonds for connecting the vertical to horizontal assemblies. In this example, the bond wire 106 is illustrated having enough length to electrically connect the AiPWB 104 (i.e., the vertical assembly) to the brick module 102 (i.e., the horizontal assembly). The bond wire 106 is attached to a surface layer 108 of the brick module 102 via a bonding-pad 110 and a connection point 112.

In general, an approximately 90-degree RF connection is established when the bond wire 106 is electrically connected to the AiPWB 104 utilizing a conductive epoxy 114. In this example, a plurality of wire bonds may be created for a brick module, for example, 80 wire bonds per brick module may be created. The wire bonds are manipulated manually and the conductive epoxy 114 is also applied manually. As such, these manual process steps are tedious and may be very expensive.

Turning to FIG. 2, in FIG. 2, an improved known approach for an assembly 200 with an angled RF connection between a rigid-flex AiPWB 202 and a brick module 204 is shown. In this example, a tab 206 is formed at an angle, which, as an example, may be 90 degrees. The tab 206 provides a flexible link between the rigid-flex AiPWB 202 and the brick module 204.

Due to the flexible structure of the tab 206, a wire bond pad 208 on the brick module 204, and a wire bond pad 210 on the tab 206, are in close proximity and on the same plane. As an improvement over the previous example described in FIG. 2, this approach allows the use of an automated wire bonder to create a bond 212 on the brick module 204, and a bond 214 on the tab 206, respectively. In this example, the bond wire 216 is short and tightly controlled, which minimizes signal degradation. Additionally, in this example, the assembly 200 provides an impedance controlled signal environment, since a trace 218 and a ground plane 220 form a micro-strip, which keeps the impedance controlled throughout the length of the transition of the tab 206. During the assembly process, the ground plane 220 may be connected to the brick module 204 by a conductive epoxy 222.

In FIGS. 3A and 3B, a known 3-D assembly 300 is shown utilizing the assembly 200 described in FIG. 2. The 3-D assembly 300 includes a radiator cell 302 for a microwave antenna assembly and is constructed using a rigid-flex AiPWB 304. In FIG. 3B, a close up view 306 of a 90-degree angled connection is shown. In this example, the tab 206 has two signal traces 308, which are connected to the brick module 204 with the bond wires 216, the close proximity of the wire bonding pads 208 and 210 allows the use of the short bond wires 216.

While an improvement over the example shown in FIG. 2, this approach still requires wire bonding and an angled tab 206, which is a flexible interconnect that requires its own assembly step in order to complete the module assembly of an AiPWB and brick module. This still results in potential yield losses and high labor costs. As such, there is a need for an improved phased-array antenna implementation that has high performance and reduced labor costs.

SUMMARY

Disclosed is an improved antenna integrated printed wiring board ("IAiPWB"). The IAiPWB includes a printed wiring board ("PWB"), a first radiating element, and a first split-via. The PWB has a bottom surface and the first radiating element is integrated into the PWB. The first radiating element has a first radiator. The first probe is in signal communication with the first radiator and the first split-via, where a portion of the first split-via is integrated into the PWB at the bottom surface.

The IAiPWB may be fabricated on a PWB utilizing a method that includes producing a PWB stack along a vertical central axis from a plurality of PWB layers. The PWB stack includes a top side, a bottom side, the first probe, and the first radiator; and the first probe includes a top portion and a bottom portion where the top portion is in signal communication with the first radiator. The method then removes a first material from the top side of the PWB stack to produce a first neck for the first radiating element and a second material from the bottom side of the PWB stack to produce the first split-via at the bottom side of the first probe. The method then adds a first conductive layer on the top side of the PWB stack and a second conductive layer on the bottom side of the PWB stack. The method then removes a first portion of the first conductive layer from the top side of the PWB stack at the first radiating element, a first portion of the second conductive layer from the bottom side of the PWB stack from a first side of the first split-via, and a second portion of the second conductive layer from the bottom side of the PWB stack from a second side of the first split-via.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
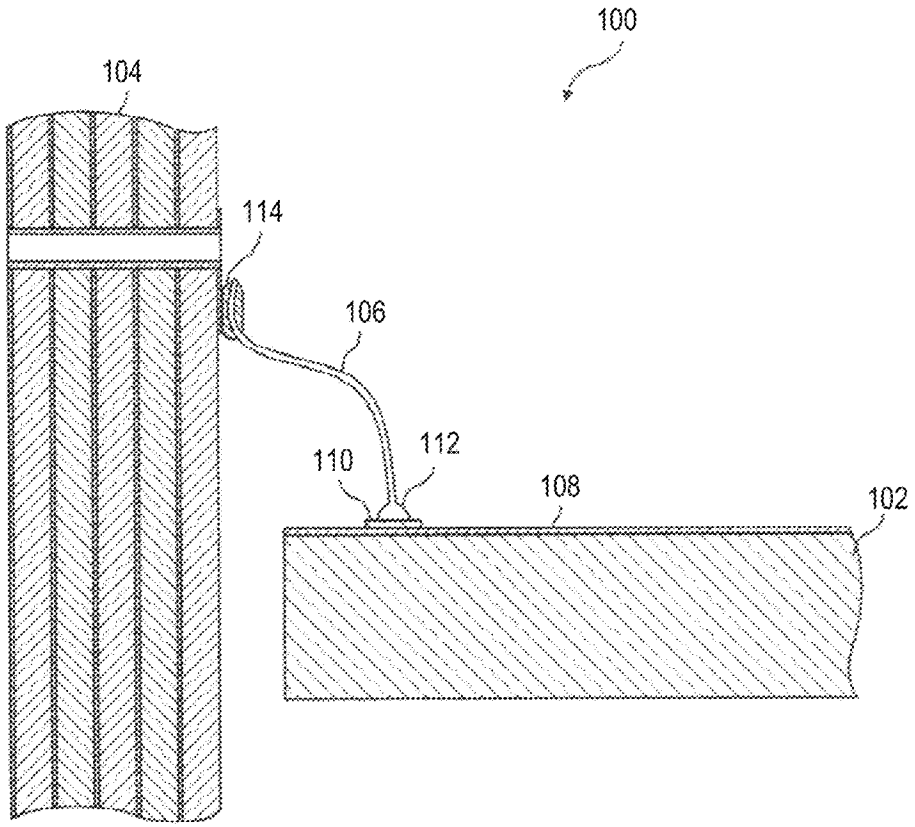
FIG. 1 (Prior Art)
FIG. 1 shows a conventional connection between an antenna integrated printed wiring board ("AiPWB") and a brick-style compact phase-array antenna module ("brick module").
Figure 2:
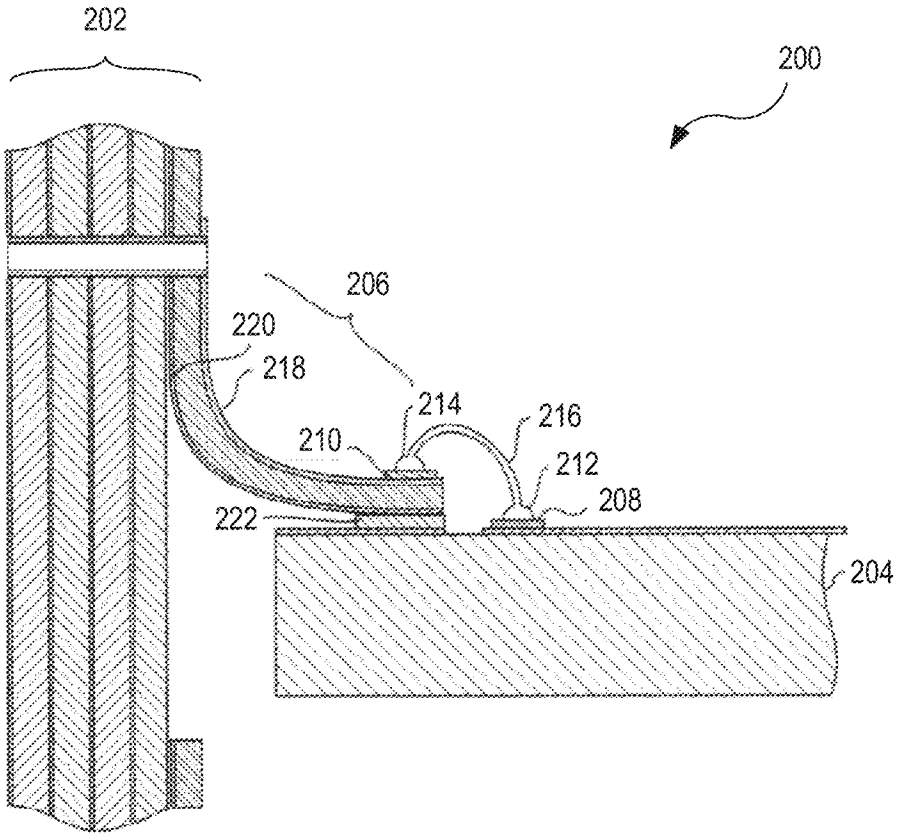
FIG. 2 (Prior Art)
FIG. 2 shows an improved known approach for an assembly with an angled RF connection between a rigid-flex AiPWB and a brick module 204.
Figure 3A:
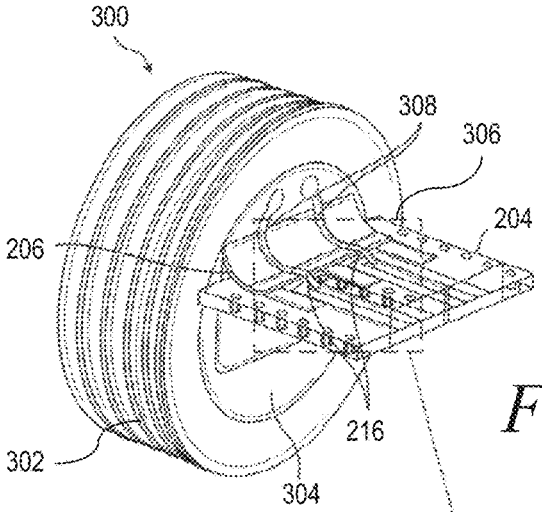
FIG. 3A (Prior Art)
FIG. 3A shows a unit cell of a microwave antenna using a known AiPWB and brick module interface.
Figure 3B:
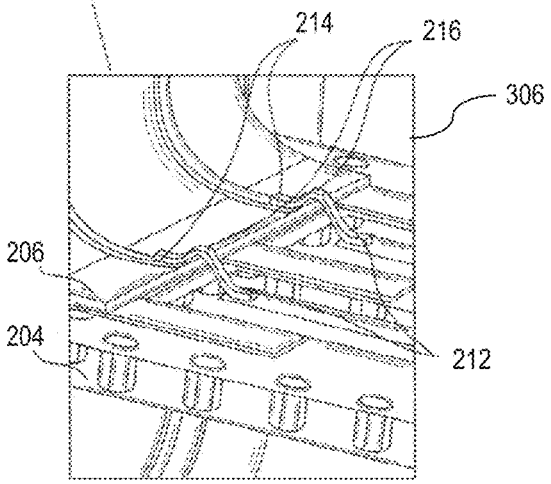
FIG. 3B (Prior Art)
FIG. 3B shows details of the interface between the AiPWB and brick module.

An improved antenna integrated printed wiring board ("IAiPWB") is disclosed. The IAiPWB includes a printed wiring board ("PWB"), a first radiating element, and a first split-via. The PWB has a bottom surface and the first radiating element is integrated into the PWB. The first radiating element has a first radiator. The first probe is in signal communication with the first radiator and the first split-via, wherein a portion of the first split-via is integrated into the PWB at the bottom surface and the first probe is in signal communication with the portion of the first split-via that is integrated into the PWB at the bottom surface.

The IAiPWB may be fabricated on a PWB utilizing a method that includes producing a PWB stack along a vertical central axis from a plurality of PWB layers. The PWB stack includes a top side, a bottom side, the first probe, and the first radiator; and the first probe includes a top portion and a bottom portion where the top portion is in signal communication with the first radiator. The method then removes a first material from the top side of the PWB stack to produce a first neck for the first radiating element and a second material from the bottom side of the PWB stack to produce the first split-via at the bottom side of the first probe. The method then adds a first conductive layer on the top side of the PWB stack and a second conductive layer on the bottom side of the PWB stack. The method then removes a first portion of the first conductive layer from the top side of the PWB stack at the first radiating element, a first portion of the second conductive layer from the bottom side of the PWB stack from a first side of the first split-via, and a second portion of the second conductive layer from the bottom side of the PWB stack from a second side of the first split-via.

The Improved Antenna Integrated Printed Wiring Board ("IAiPWB")

FIGS. 4A-4F describe the IAiPWB 400 in accordance with the present disclosure. Specifically, in FIG. 4A, a perspective-view of an example of an implementation of an IAiPWB 400 is shown in accordance with the present disclosure. In this example, the IAiPWB 400 is shown with sixteen (16) radiating elements 402, 404, 406, 408, 410, 412, 414, 416, 418, 420, 422, 424, 426, 428, 430, and 432 over a top plate 434 acting as a ground plane. The top plate 434 is constructed of a conductive material that may be a metal such as, copper, aluminum, gold, or other conductive plating metal.

It is appreciated by those of ordinary skill in the art that instead of sixteen (16) radiating elements, the IAiPWB 400 may include any plurality of radiating elements for the design of the IAiPWB 400. In this example, the IAiPWB 400 is shown as 2 by 8 array of radiating elements that may be in signal communication with a brick-style compact phase-array antenna module ("brick module") that houses the electronics to drive and control the radiating elements 402, 404, 406, 408, 410, 412, 414, 416, 418, 420, 422, 424, 426, 428, 430, and 432 in the IAiPWB 400. Additionally, in this example, the radiating elements 402, 404, 406, 408, 410, 412, 414, 416, 418, 420, 422, 424, 426, 428, 430, and 432 are spaced apart along the top plate 434 to form a lattice structure that is predetermined based on the design of the complete antenna array. The IAiPWB 400 may define a single 2 by 8 antenna array or a portion of a larger antenna array, where the IAiPWB 400 is a single 2 by 8 radiating element of the larger antenna array. The edge 436 of the IAiPWB 400 may be curved or straight based on whether the IAiPWB 400 is a portion of a larger antenna array and the lattice structure of radiating elements of the larger antenna array, where the edge 436 allows multiple IAiPWBs to be placed together in a way that maintains the proper inter-element element between the radiating elements of the larger antenna array.

In this perspective-view, each of the radiating elements 402, 404, 406, 408, 410, 412, 414, 416, 418, 420, 422, 424, 426, 428, 430, and 432 are shown as extending outward in a normal direction from the top plate 434 and having a neck that is plated with the same conductive material as the top plate 434. In this example, the top of each radiating element 402, 404, 406, 408, 410, 412, 414, 416, 418, 420, 422, 424, 426, 428, 430, and 432 is shown as having a non-plated material that may be the uncovered top of the surface of an individual radiating element or a dielectric material covering the surface of the individual radiating element. In this example, layout of the IAiPWB 400 shows that the plurality of radiating elements 402, 404, 406, 408, 410, 412, 414, 416, 418, 420, 422, 424, 426, 428, 430, and 432 are spaced along the top plate 434 in a first plane 435 that is an X-Y plane defined by X-axis 437A and Y-axis 437B. The neck of each of the radiating elements 402, 404, 406, 408, 410, 412, 414, 416, 418, 420, 422, 424, 426, 428, 430, and 432 extends outward from the first plane 435 in a second plane 439 that may be an X-Z plane or Y-Z plane along the Z-axis 437C. In this example, the first plane 435 has a first orientation and the second plane 439 has a second orientation, where the second orientation that is perpendicular or approximately perpendicular to the first orientation.

Figure 4A:
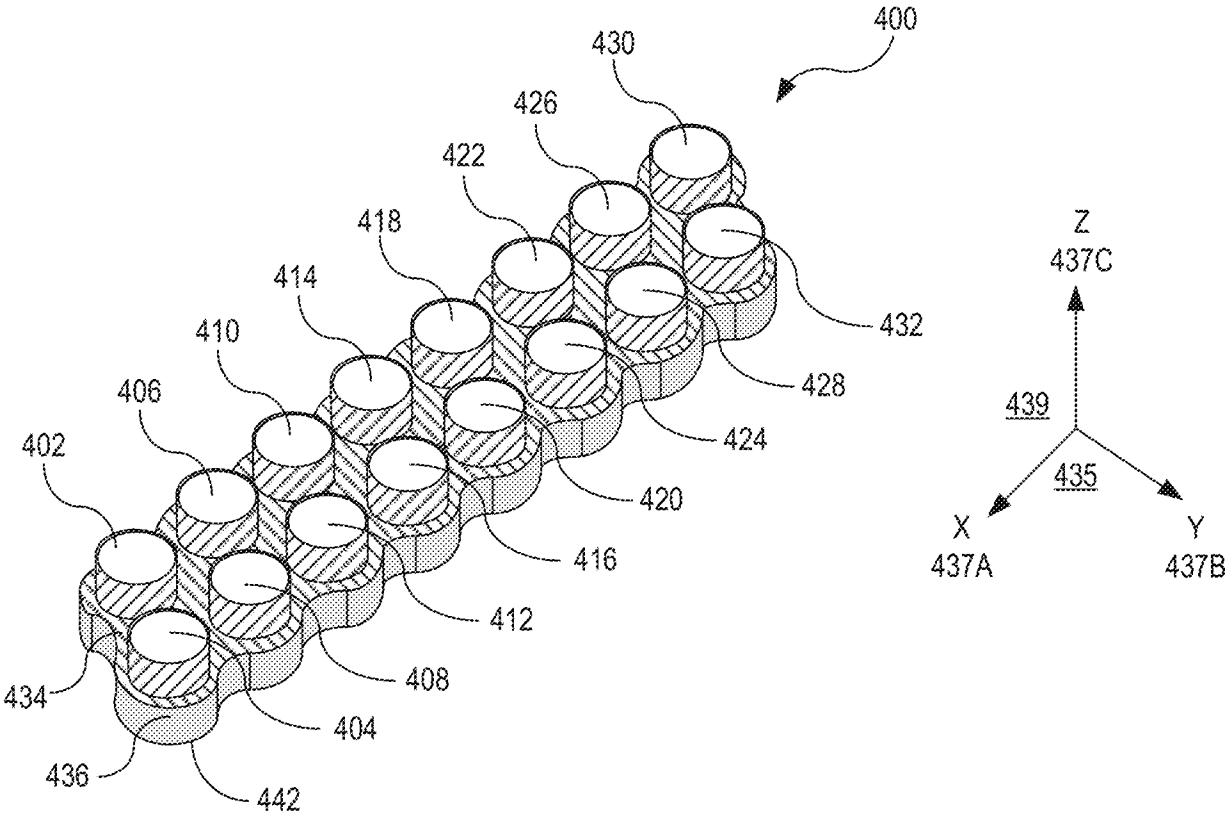
FIG. 4A is a perspective-view of an example of an implementation of an improved antenna integrated printed wiring board ("IAiPWB") in accordance with the present disclosure.
Figure 4B:
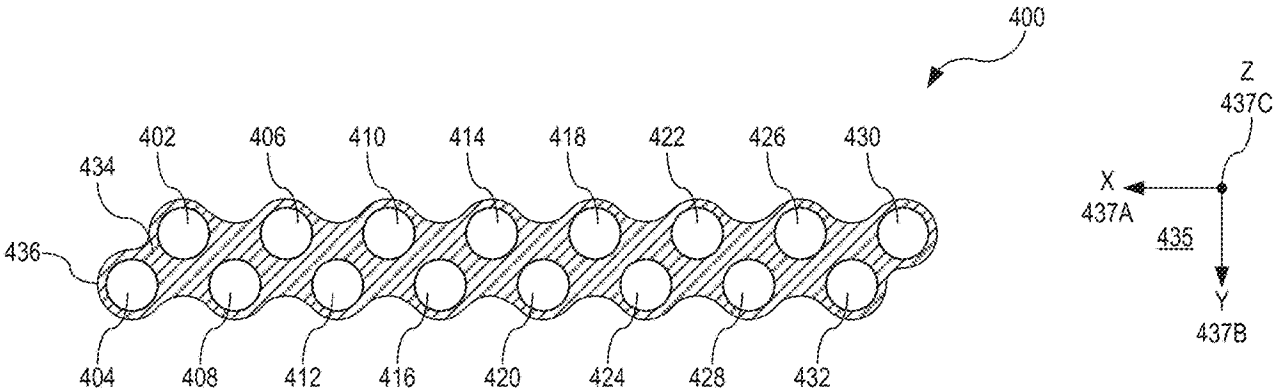
FIG. 4B is a top-view of the IAiPWB shown in FIG. 4A in accordance with the present disclosure.
Figure 4C:
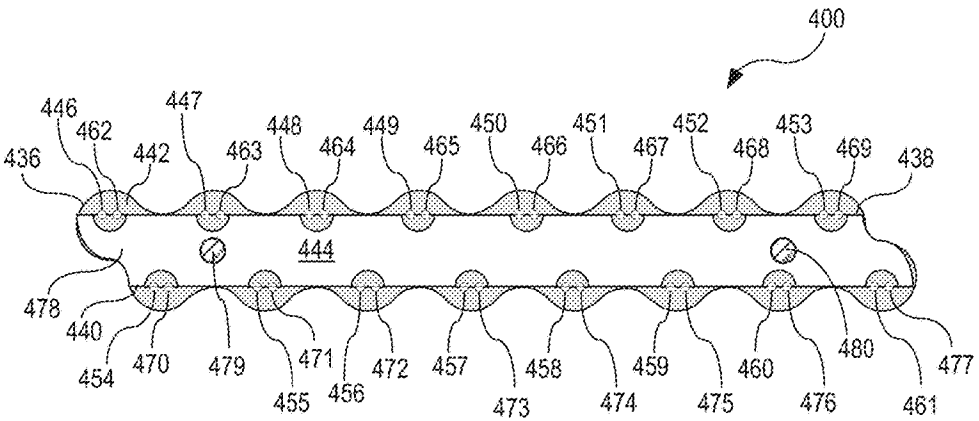
FIG. 4C is a bottom-view of the IAiPWB shown in FIGS. 4A and 4B in accordance with the present disclosure.

In FIG. 4B, a top-view of the IAiPWB 400 is in accordance with the present disclosure and in FIG. 4C, a bottom-view of the IAiPWB 400 is shown in accordance with the present disclosure. In this example, the bottom-view shows a first ledge 438 and a second ledge 438 on the bottom surface 442 of the IAiPWB 400 and beneath the edge 436, where the first ledge 438 and second ledge 438 form a bottom-ledge surface 444. In this example, the IAiPWB 400 includes a plurality of first split-vias 446, 447, 448, 449, 450, 451, 452, 453, 454, 455, 456, 457, 458, 459, 460, and 461 and a plurality of second split-vias 462, 463, 464, 465, 466, 467, 468, 469, 470, 471, 472, 473, 474, 475, 476, and 477 extending outward from the bottom surface 442 of the IAiPWB 400. The bottom-ledge surface 444 may be plated with a bottom conductive material 478 that may be the same as the top plate 434 conductive material. The bottom conductive material 478 may act as ground plane and may include a plurality of cut-outs around the plurality of first split-vias 446, 447, 448, 449, 450, 451, 452, 453, 454, 455, 456, 457, 458, 459, 460, and 461 and a plurality of second split-vias 462, 463, 464, 465, 466, 467, 468, 469, 470, 471, 472, 473, 474, 475, 476, and 477 so as to not short them out. The bottom-ledge surface 444 may also include a first guide pin 479 and second guide pin 480 to properly interface and align the IAiPWB 400 with a corresponding brick module.

Figure 4D:
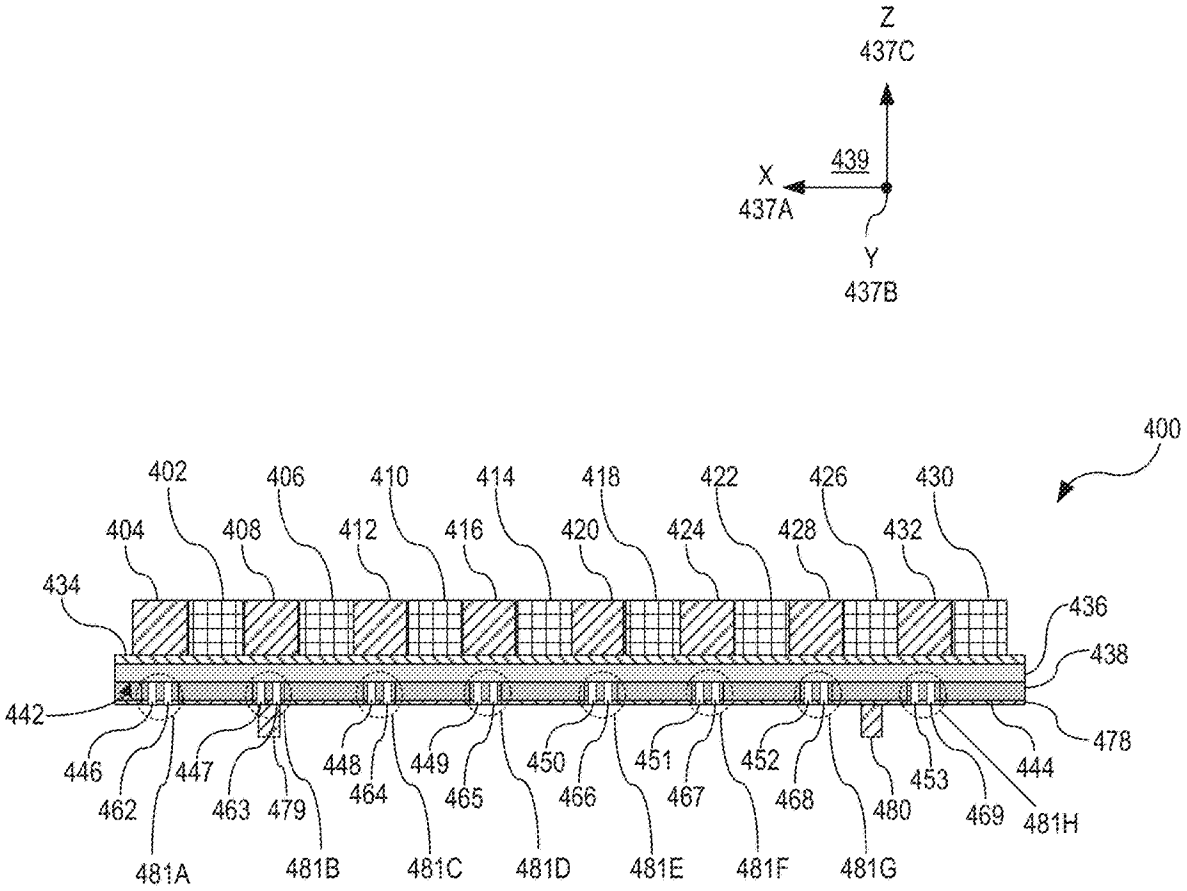
FIG. 4D is a side-view of the IAiPWB shown in FIGS. 4A-4C in accordance with the present disclosure.
Figure 4E:
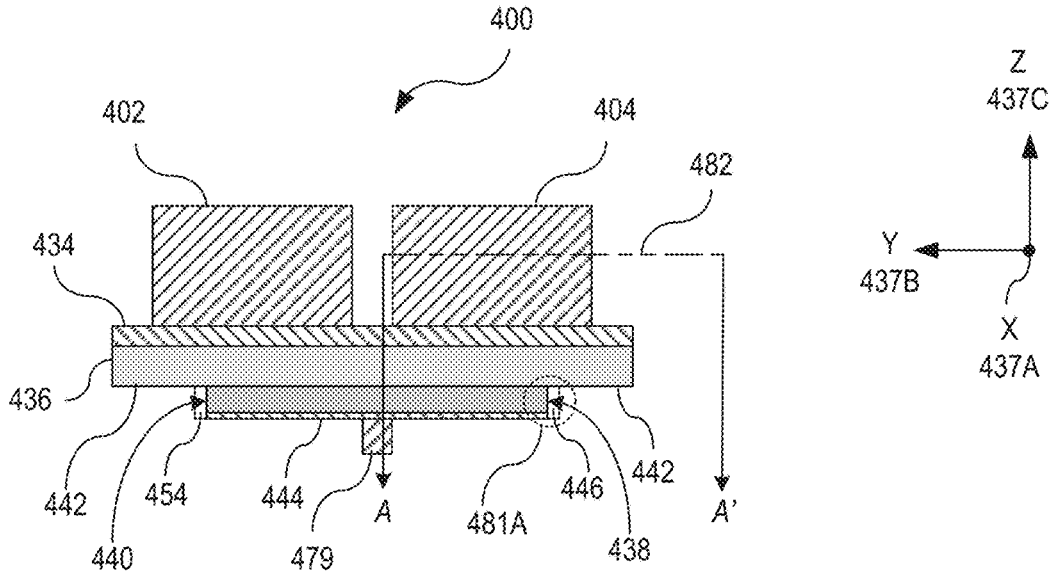
FIG. 4E is a front-view of the IAiPWB shown in FIGS. 4A-4D in accordance with the present disclosure.

In FIG. 4D, a side-view of the IAiPWB 400 is shown in accordance with the present disclosure and in FIG. 4E, a front-view of the IAiPWB 400 is shown in accordance with the present disclosure. In this example, the first plurality of split-vias 446, 447, 448, 449, 450, 451, 452, 453, 454, 455, 456, 457, 458, 459, 460, and 461 and second plurality of split-vias 462, 463, 464, 465, 466, 467, 468, 469, 470, 471, 472, 473, 474, 475, 476, and 477 each include a first portion and a second portion. In general, all of the first ports of both the first plurality of split-vias 446, 447, 448, 449, 450, 451, 452, 453, 454, 455, 456, 457, 458, 459, 460, and 461 and second plurality of split-vias 462, 463, 464, 465, 466, 467, 468, 469, 470, 471, 472, 473, 474, 475, 476, and 477 is integrated into the bottom surface 442.

Specifically, in FIG. 4D, a sub-plurality of the first split-vias 446, 447, 448, 449, 450, 451, 452, and 453 and sub-plurality of the second split-vias 462, 463, 464, 465, 466, 467, 468, and 469 are shown as extending out from the bottom surface 442 of the IAiPWB 400.

The first portion of each of the split-vias of the sub-plurality of the first split-vias 446, 447, 448, 449, 450, 451, 452, and 453 and sub-plurality of the second split-vias 462, 463, 464, 465, 466, 467, 468, and 469 is integrated into the bottom surface 442 of the PWB of the IAiPWB 400 and the second pairs of each of the split-vias of the sub-plurality of the first split-vias 446, 447, 448, 449, 450, 451, 452, and 453 and sub-plurality of the second split-vias 462, 463, 464, 465, 466, 467, 468, and 469 (as shown in the second portion pairs 481A, 481B, 481C, 481D, 481E, 481F, 481G, and 481H of each of the pairs of first split-via and second split-vias 446, 462, 447, 463, 448, 464, 449, 465, 450, 466, 451, 467, 452, 468, 453, and 469, respectively) is shown integrated into the ledge 438.

Figure 4F:
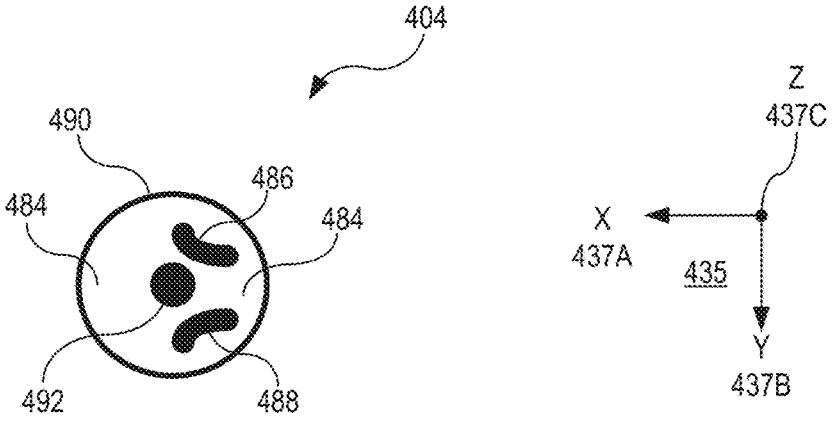
FIG. 4F is a cross-sectional top-view of an example of an implementation of radiating element for use with the IAiPWB, shown in FIGS. 4A-4E, in accordance with the present disclosure.

In FIG. 4E, the first radiator 402 and second radiator 404 are shown. As shown in FIG. 4D, the second portion of the first split-via 446 is shown integrated into the first ledge 438 and a second portion of the first split-via 470 is shown integrated into the second ledge 440. Turning to FIG. 4F, a cross-sectional top-view of an example of an implementation of the radiating element 404 is shown in accordance the present disclosure. The cross-sectional top-view in FIG. 4F is looking into the radiating element 404 along the cutting plane A-A' 482 shown in FIG. 4E.

In this example, the radiating element 404 is formed and/or etched on a printed wire board ("PWB") 484. The radiating element 404 may include a first radiator 486 and second radiator 488. The first radiator 486 is fed by a first probe (not shown) that is in signal communication with the T/R module (not shown) and the second radiator 488 is fed by a second probe (not shown) that is also in signal communication with the T/R module (not shown). In this example, the first radiator 486 and second radiator are arranged along the first plane 435

In this example, the first radiator 486 may radiate a first type of polarization (such as, for example, vertical polarization or right-hand circular polarization) and the second radiator 488 may radiate a second type of polarization (such as, for example, horizontal polarization or left-hand circular polarization) that is orthogonal to the first polarization. Also shown in this example is a neck 490 of the radiating element 404 that, as described earlier, is plated with the same conductive material as the top plate 434. In this example, the neck 490 is a grounding and/or isolation element that acts an electrically conductive wall of a cylindrical waveguide (e.g., in the shape of "can" or a "tube") for first radiator 486 and second radiator 488. Additionally, in this example, an optional ground via 492 is shown as being concentric with the neck 490 between the first radiator 486 and second radiator 488. If present, the optional ground via 492 acts a grounding post that helps tune bandwidth of the radiating element 404. It is appreciated by those of ordinary skill in the art that the radiating element 404 may include a different type of configuration based on the desired design parameters of the IAiPWB 400. For example, the radiating element 404 may only include the first radiator 486 if only one polarization is desired or only the second radiator 488 if another polarization is desired.

It is appreciated by those of ordinary skill in the art that for this example the cylindrical waveguides would typically support, for example and without limitation, the $TM_{01}$, $TM_{02}$, $TM_{11}$, $TE_{01}$, and $TE_{11}$ modes of operation. However, without loss of generalization, it is also appreciated by those of ordinary skill in the art that for some other types of applications, other types of waveguide structures of the necks of the radiating elements may be appropriate such as, for example, a rectangular, square, elliptical, or other equivalent type of waveguide.

Figure 4G:
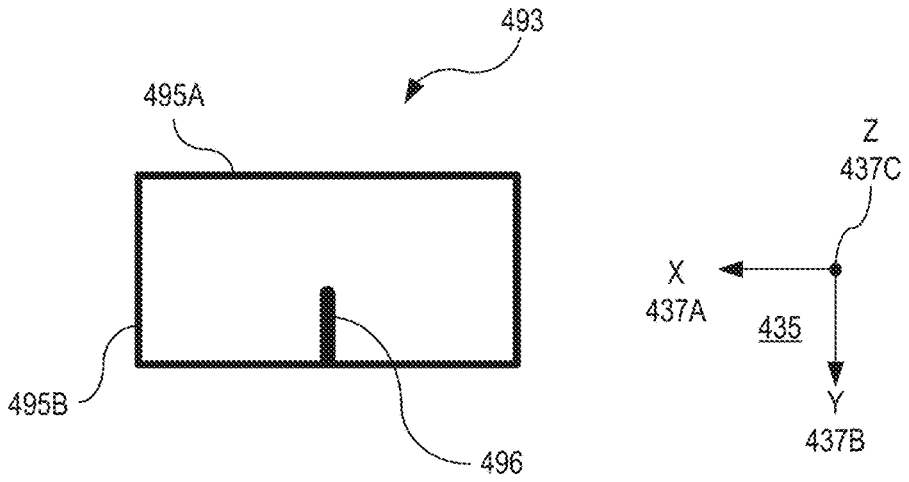
FIG. 4G is a cross-sectional top-view of an example of an implementation of a rectangular radiating element in accordance with the present disclosure.
Figure 4H:
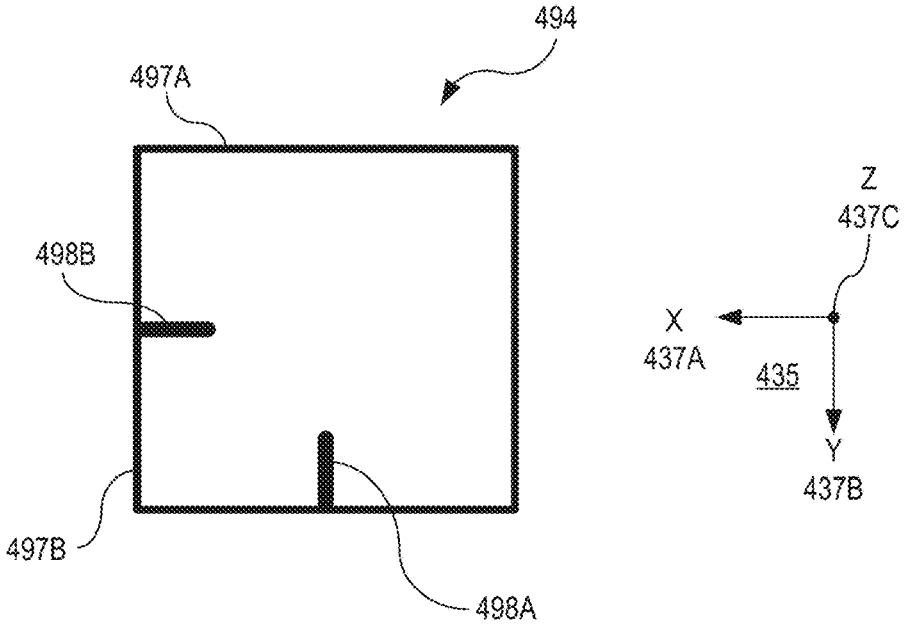
FIG. 4H is a cross-sectional top-view of an example of an implementation of a square radiating element is shown in accordance with the present disclosure.

Turning to FIGS. 4G and 4H, an example of rectangular radiating element 493 and square radiating element 494 is shown in accordance with the present invention. Specifically, in FIG. 4G, a cross-sectional top-view of an example of an implementation of the rectangular radiating element 493 is shown in accordance with the present disclosure. In this example, the rectangular radiating element 493 is a rectangular waveguide that may have a broad wall 495A along the X-axis 437A and a narrow wall 495B along the Y-axis 437B. In this example, the rectangular radiating element 493 may include a rectangular waveguide radiator 496 within the rectangular radiating element 493. It is appreciated by those of ordinary skill in the art that an example of the rectangular waveguide radiator 496 may be, for example, a short dipole that may excite a mode of operation within the rectangular radiating element 493 such as, for example and without limitation, $TE_{10}$, $TE_{11}$, $TE_{01}$, $TE_{21}$, $TE_{20}$, $TM_{11}$, and $TM_{21}$. As described earlier, rectangular waveguide radiator 496 may be in signal communication with a probe (i.e., the first probe that feeds the first radiator 486 in FIG. 4F) that feeds the rectangular waveguide radiator 496. It is further appreciated by those of ordinary skill in the art that based on the desired radiation pattern and polarization, the rectangular radiating element 493 may alternatively be positioned such that the broad wall 495A is along the Y-axis 437B and the narrow wall 495B is along the X-axis 437A.

Alternatively, in FIG. 4H, a cross-sectional top-view of an example of an implementation of the square radiating element 494 is shown in accordance with the present disclosure. In this example, the square radiating element 494 may be an approximately square waveguide having a first wall 497A and second wall 497B that are approximately equal in length. The first wall 497A may be along the X-axis 437A and the second wall 497B may be along the y-axis 437B. Furthermore, unlike the rectangular radiating element 493, in this example, the square radiating element 494 may include a first square waveguide radiator 498A and a second square waveguide radiator 498B within the square radiating element 494. In this example both the first square waveguide radiator 498A and second square waveguide radiator 498B may be, for example, a short dipole that may excite a mode of operation within the rectangular radiating element 493 such as, for example and without limitation, $TE_{10}$, $TE_{11}$, $TE_{01}$, $TE_{21}$, $TE_{20}$, $TM_{11}$, and $TM_{21}$.

As described earlier, the first square waveguide radiator 498A may be in signal communication with a first probe (i.e., the first probe that feeds the first radiator 486 in FIG. 4F) that feeds the first square waveguide radiator 498A and the second square waveguide radiator 498B may be in signal communication with a second probe (i.e., the second probe that feeds the second radiator 488 in FIG. 4F) that feeds the second square waveguide radiator 498B. It is appreciated by those of ordinary skill in the art that based on the desired radiation pattern and polarization, the square radiating element 494 may produce a horizontal or vertical linear polarized radiation pattern or a right or left handed circular polarized radiation pattern.

It is furthermore appreciated by those of ordinary skill in the art that the term "via" is a path through a PWB and generally stands for "vertical interconnect access." It is also appreciated by those of ordinary skill in the art that the circuits, components, modules, and/or devices of, or associated with, the IAiPWB are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

Figure 5:
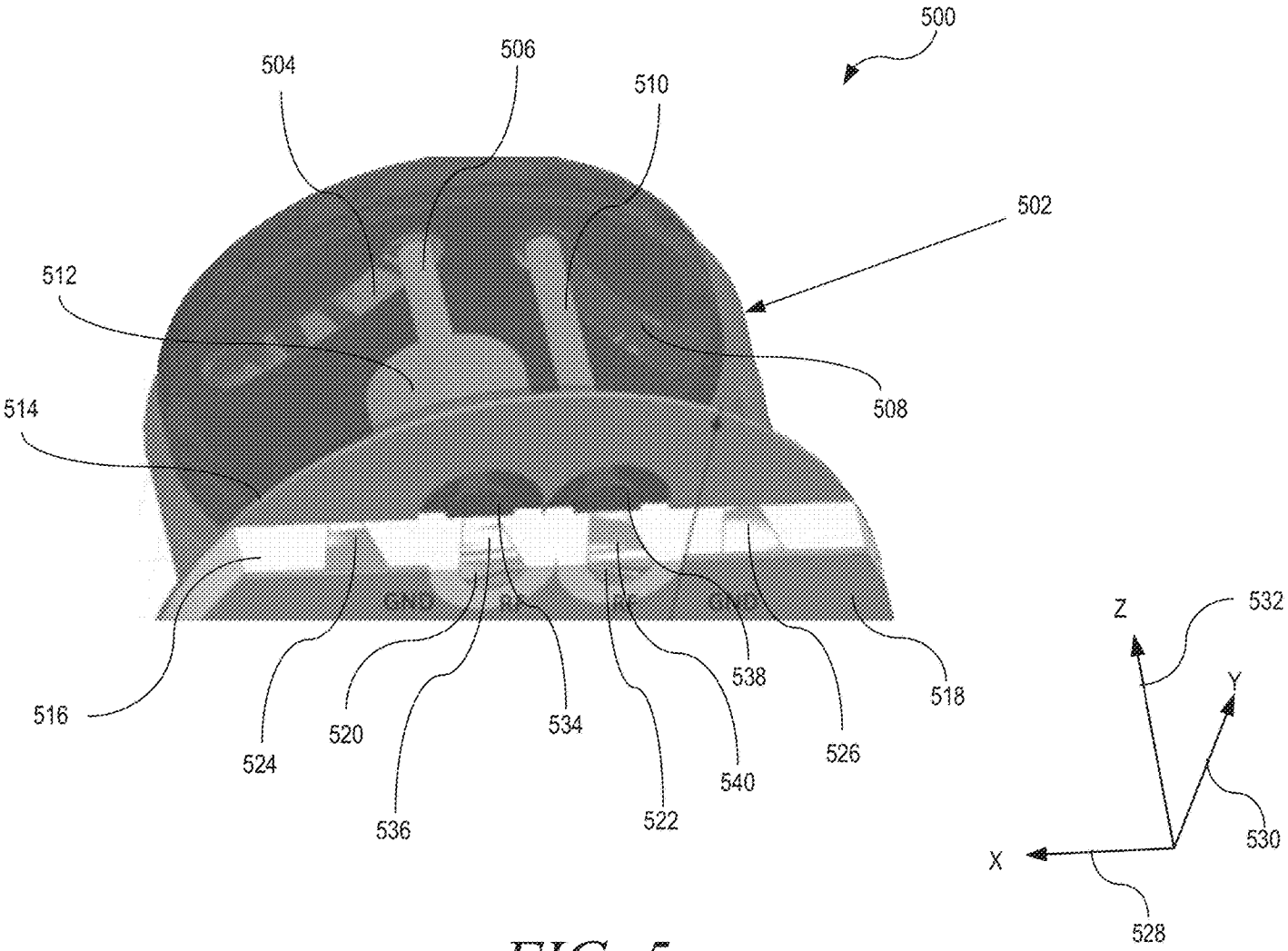
FIG. 5 is a system bottom perspective-view of an example of an implementation of a radiating element in accordance with the present disclosure.

In FIG. 5, a system bottom perspective-view of an example of an implementation of a radiating element 500 is shown in accordance with the present disclosure. In this example, neck 502 of the radiating element 500 is drawn transparently to shown an example of an implementation of the first radiator 504 in signal communication with a first probe 506, second radiator 508 in signal communication with a second probe 510, and an optional grounding via 512. In this example, the neck 502 is shown extending out from the top plate 514. For ease of illustration, the dielectric layer material of the PWB under the top plate 514 that corresponds to the edge 436 of the IAiPWB 400 is not shown. However, it is appreciated by those of ordinary skill in the art that it is present and will be described in more detail later in the present disclosure. A ledge 516 is shown that may correspond to either the first ledge 438 or second ledge 440 and a bottom-ledge surface 518 is shown that corresponds to the bottom-ledge surface 444.

In this example, a first split-via 520 and second split-via 522 are shown in signal communication with corresponding first probe 506 and second probe 510, respectively. Additionally, a first grounding via 524 and second grounding via 526 are shown in electrically connecting the top plate 514 and the bottom-ledge surface 518. As described earlier, in this example, the bottom-ledge surface 518 may include a plating of the bottom conductive material 478.

For this bottom perspective-view, the first radiator 504, second radiator 508, top plate 514, and bottom-ledge surface 518 are shown to be horizontal assembly structures located in an X-Y plane (i.e., a first plane) defined by an X-axis 528 and Y-axis 530 having a first orientation. The first probe 506, second probe 510, optional ground plane via 512 and shown to be vertical structures within the IAiPWB 400 extending along a Z-axis 532 in a second plane having a second orientation. As discussed earlier, the second orientation is approximately perpendicular (i.e., 90 degrees) to the first orientation. Moreover, as discussed earlier, the first split-via 520 and second split-via 522 are structures that have both a horizontal portion (the portions that are in signal communication with the first probe 506 and second probe 510) and a vertical portion that is located on the ledge 516. The horizontal portion is the first portion of the split-via that is integrated into the PWB and the vertical portion is the second portion of the split-via that is integrated into the ledge 516. More specifically, in this example, the first portion 534 of the first split-via 520 is shown integrated in the PWB, the second portion 536 of the first split-via 520 is shown integrated in ledge 516, the first portion 538 of the second split-via 522 is shown integrated in the PWB, and the second portion 540 of the second split-via 522 is shown integrated into the ledge 516. As such, in this example, the second portion 536 of the first split-via 520 and second portion 540 of the second split-via 522 allow for wire bonding the IAiPWB 400 to a brick module along a vertical orientation (i.e., in the second plane along the Z-axis 532) without the need for flexible structure that bends the wire bond by approximately 90 degrees.

Figure 6:
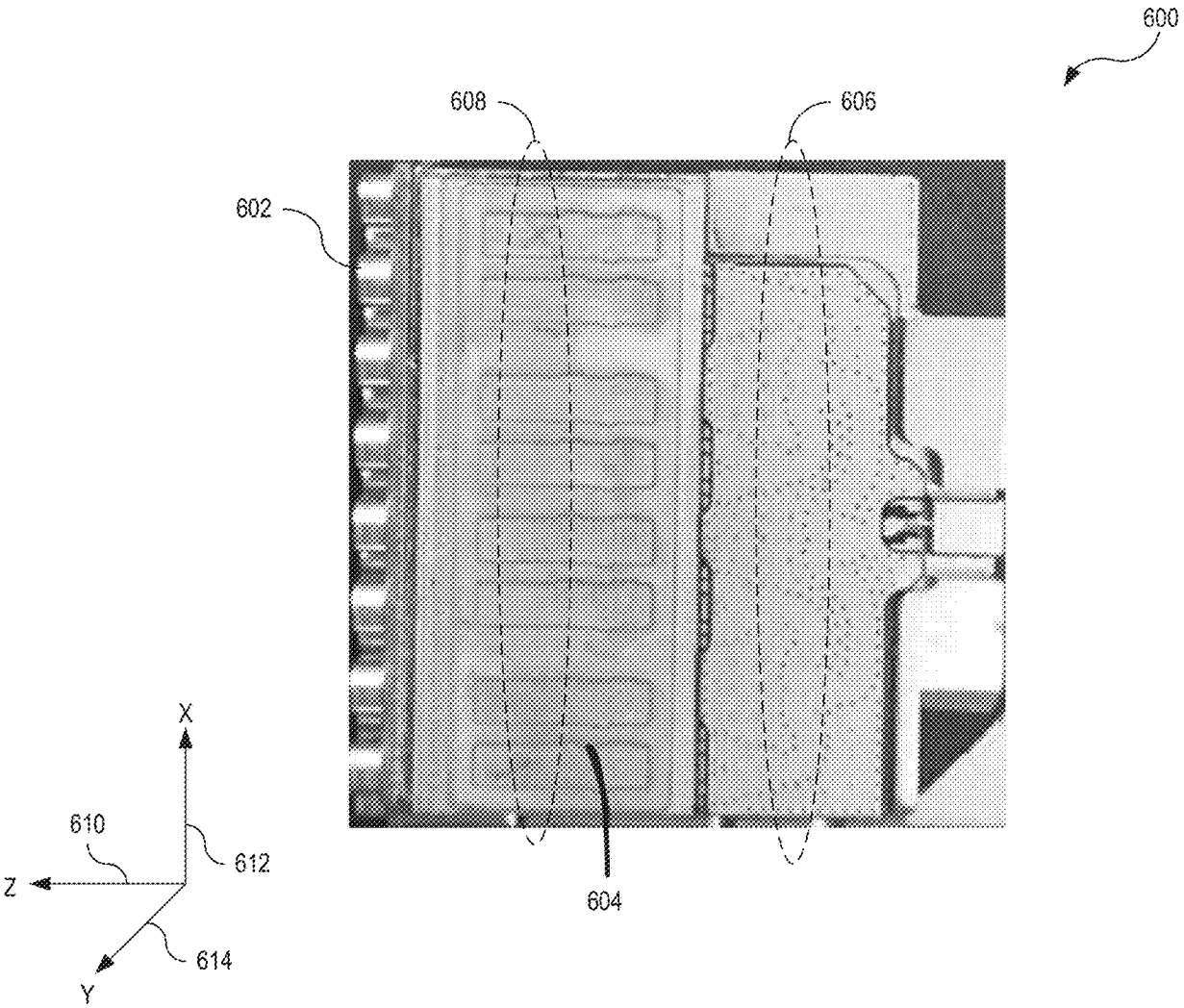
FIG. 6 is a side-view of an antenna module in accordance with the present disclosure.
Figure 7:
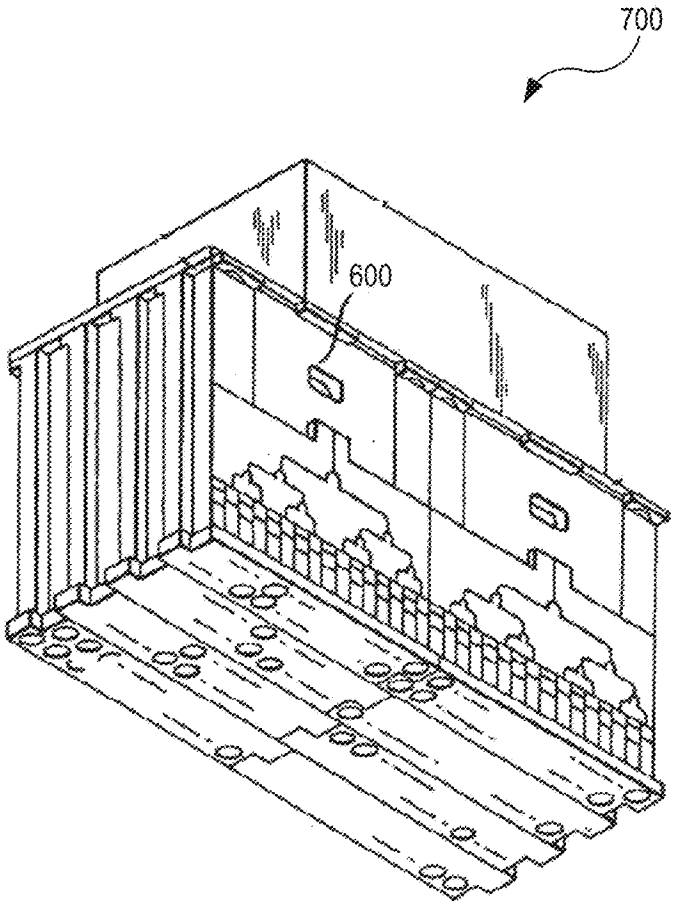
FIG. 7 is a perspective-view of an antenna system incorporating eight (8) antenna modules shown in FIG. 6 in accordance with the present disclosure.

In FIG. 6, a side-view of an antenna module 600 in accordance with the present disclosure. In this example, the antenna module 600 includes IAiPWB 602 and a brick module 604. The brick module 604 includes a feed network 606 and a plurality of T/R modules 608. It is appreciated by those of ordinary skill in the art that the brick module 604 is generally utilized because at high frequencies (for example, greater than 46 GHz), the array lattice of radiating elements generally leaves very little room for the electronics on the brick module 604. As such, the brick module 604 lays out the electronics and other components in a vertical assembly (i.e., the second plane along the Z-axis 610) that needs to interface with the IAiPWB 602 that is a horizontal assembly (i.e., first plane along the X-Y plane defined by the X-axis 612 and Y-axis 614). The plurality of first split-vias 446, 447, 448, 449, 450, 451, 452, 453, 454, 455, 456, 457, 458, 459, 460, and 461 and the plurality of second split-vias 462, 463, 464, 465, 466, 467, 468, 469, 470, 471, 472, 473, 474, 475, 476, and 477 in the IAiPWB 602 enable the brick module 604 to electrically connect each radiating element to the corresponding T/R modules in the brick module 604 without the need of a flexible bend from the vertical orientation of the brick module 604 to the horizontal orientation of the IAiPWB 602 since the split-vias allow wire bonding the connections to the brick module 604 in the vertical orientation (i.e., the second orientation) since part of the split-vias are located flat along the surface of the ledge. As such, the split-vias allow the IAiPWB 602 to be mounted at approximately 90 degrees relative to the brick module 604. In general, an antenna system may include a plurality of antenna modules similar to the antenna module 600 placed together to form a larger antenna system having a larger two-dimensional horizontal lattice of radiating elements that includes a plurality of IAiPWBs. As an example, in FIG. 7, a perspective-view of an example of an implementation of an antenna system 700 incorporating eight (8) antenna modules (including antenna module 600) is shown in accordance with the present disclosure.

Figure 8:
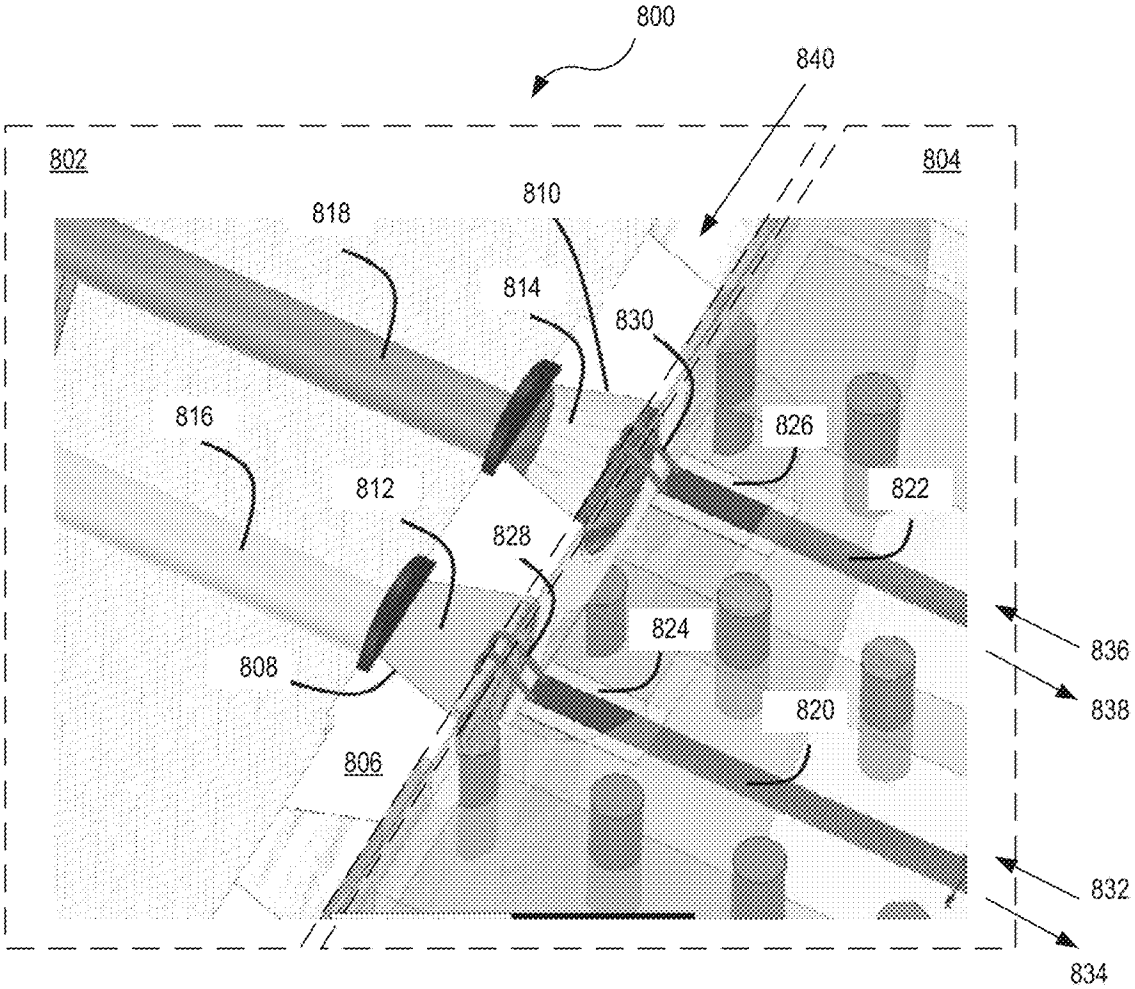
FIG. 8 is a close-up perspective view of an example of an implementation of a split-via and wire bonding interface in accordance with the present disclosure.

Turning to FIG. 8, a close-up perspective view of an example of an implementation of a split-via and wire bonding interface 800 is shown in accordance with the present disclosure. In this example, the split-via and wire bonding interface 800 is an interface between the IAiPWB 802 and a brick module 804 along the ledge 806 (which may be the either the first ledge 438 or the second ledge 440). As described later, the ledge 806 may be formed by routing (e.g. cutting), carving, or etching through a layer of the PWB having a plurality of solid vias. By forming (i.e., cutting or etching) an edge that results in the ledge 806, the second portion of the first split-via 808 and the second split-via 810 are formed as a first and second side contacts 812 and 814, respectively, that may be utilized in a wire bonding process that electrically connects the first split-via 808 and second split-via 810 to the brick module 804. In this example, the first split-via 808 is in signal communication with the first probe 816 and the second split-via 810 is in signal communication with the second probe 818.

In this example, the brick module 804 includes electronic devices (not shown) and signal distribution network (not shown) that feed and control the operation of the IAiPWB 802. For the purpose of simplicity of illustration, the brick module 804 is only shown having a first signal trace 820, second signal trace 822, first wire bonding pad 824, and second wire bonding pad 826. The first signal trace 820 is in signal communication with the first wire bonding pad 824 and the second signal trace 822 is in signal communication with the second wire bonding pad 826. The first wire bonding pad 824 is then electrically connected to the first side contact 812 via a first wire bond 828 and second wire bonding pad 826 is electrically connected to the second side contact 814 via a second wire bond 830.

As illustrated, the first and second side contacts 812 and 814 of the first and second split-vias 808 and 810, respectively, are substantially planar (e.g. in a parallel plane) with their corresponding wire bonding pads 824 and 826, to facilitate a wire bonding connection. In this manner, transmit signals 832 and 834 and receive signals 836 and 838 on the first and second signal traces 820 and 822, respectively traverse an air trough (e.g. air gap) 840 by wire bonds between transmitters and receivers through an interconnection network on the brick module 804 and corresponding antenna elements on the IAiPWB 802.

Figure 9:
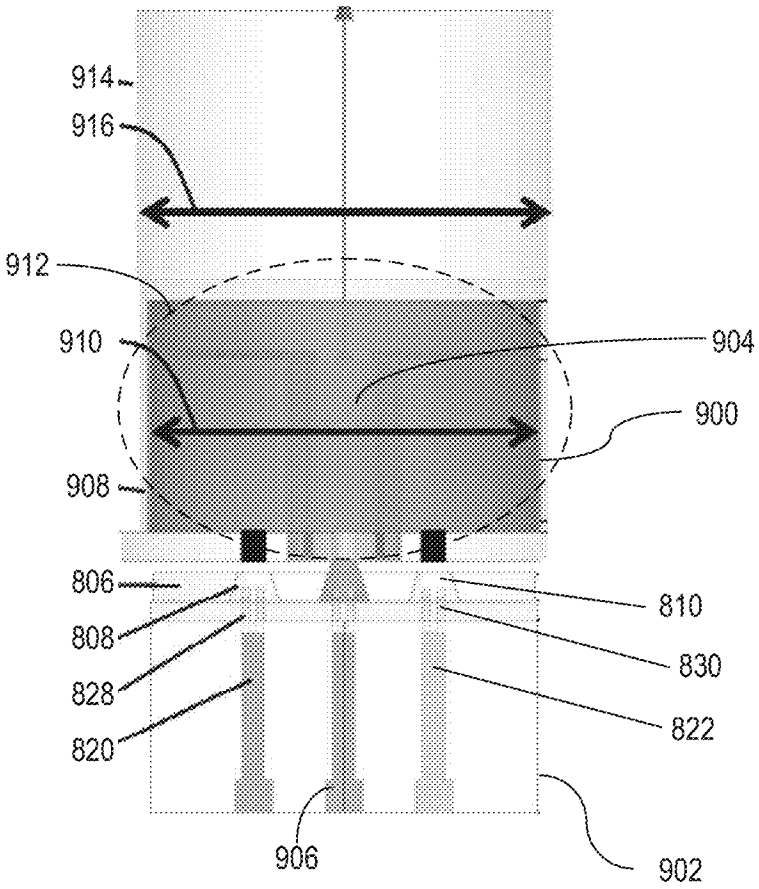
FIG. 9 is a partial side-view of an example of an implementation of IAiPWB connected to a portion of the brick module in accordance with the present disclosure.

In FIG. 9, a partial side-view of an example of an implementation of IAiPWB 900 connected to a portion of the brick module 902 in accordance with the present disclosure. As described earlier, the brick module 902 is in signal communication with the IAiPWB 900 via one or more wire bonds (e.g., first wire bonds 828 and second wire bonds 830) that electrically connect the first signal trace 820 to the first split-via 808 and the second signal trace 822 to the second split-via 810. In various embodiments, one or more wire bonds may be used for each connection. In this example, a ground via 904 is also shown in signal communication with a ground plane 906 on the brick module 902. Moreover, the IAiPWB 900 includes a neck 908 in the shape of a cylinder and plated continuously with conductive material. As described earlier the neck 908 surrounds each radiating element in the IAiPWB 900 in a way that forms a true continuous cylindrical waveguide surrounding the radiators within the radiating elements. As an example of fabrication, the conductive material may be fabricated utilizing ROGERS® 3202 (i.e. Ro3202) material having a dielectric constant of about 3.00, which is available from Rogers Corporation in Rogers, Conn., USA. As an example, the diameter 910 of the radiating element 912 may be 0.105 inches. Moreover, disposed on the top side of the radiating element 912 may be a dielectric material 914. The dielectric material may be composed of REXOLITE® available from C-Lec Plastics, of Philadelphia, Pa., USA. As an example, the diameter 916 of the REXOLITE® dielectric portion may be 0.114 inches.

Based on FIGS. 4A-9 and the associated description, disclosed is IAiPWB that includes: a PWB having a bottom surface; a first radiating element; and a first split via in signal communication with a first probe. The first radiating element includes a first radiator and the first probe in signal communication with the first radiator, where the first radiating element is integrated into the PWB. The first split-via includes a first portion that is integrated into the PWB at the bottom surface.

The IAiPWB may also include a second radiator in the first radiating element that is also integrated into the PWB and a second split-via. The first radiating element would then also include a second probe in signal communication with the second radiator. The second probe is then in signal communication with the second radiator and the second split via is in signal communication with the second probe. The first portion of the second split via is also integrated into the PWB at the bottom surface. The first radiating element may include a ground via that is proximate to the first radiator and the second radiator, where the ground via is also integrated into the PWB.

The PWB includes a ledge at the bottom surface and the second portion of the first split via is integrated into the ledge. The second portion of the second split via is also integrated into the ledge. In this example, the first radiator is arranged along a first plane having a first orientation, the second portion of the first split via is integrated into the ledge along a second plane having a second orientation, and the second orientation is approximately perpendicular to the first orientation. The IAiPWB also includes a neck of plated conductive material forming a cylinder around the first radiating element.

In general, examples for use of the IAiPWB may include line-of-sight communication systems at Q-band or radar systems at Ka-band.

Fabricating the IAiPWB

Figure 10A:
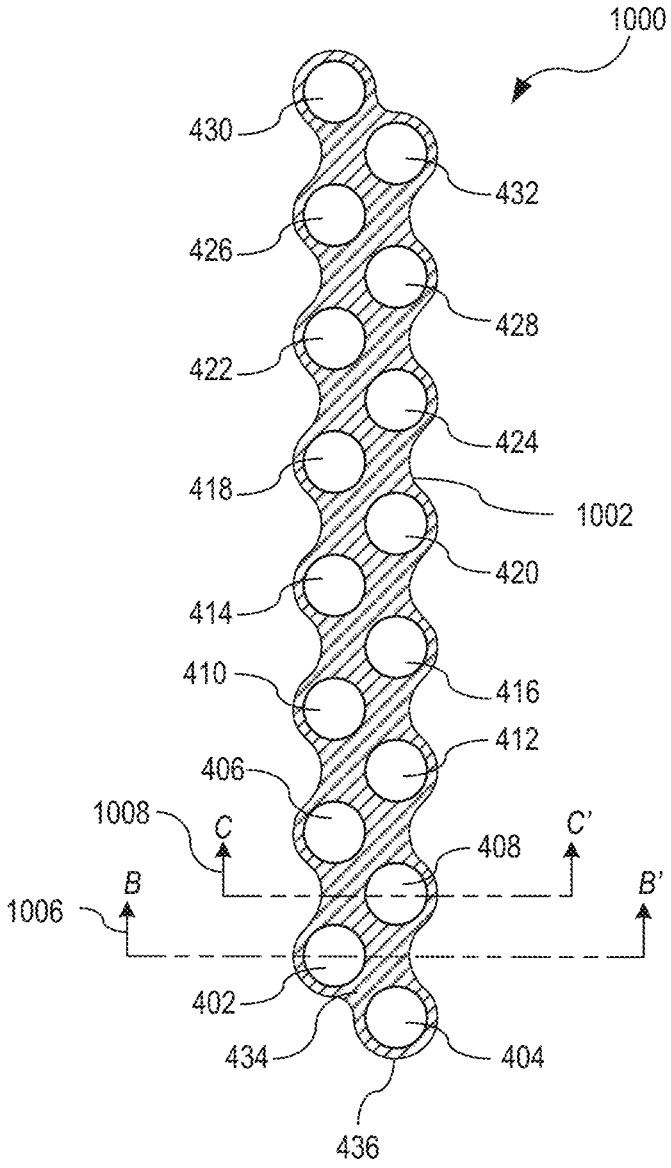
FIG. 10A is a top-view of an example of an implementation of the IAiPWB in a primed wired board ("PWB") in accordance with the present disclosure.
Figure 10C:
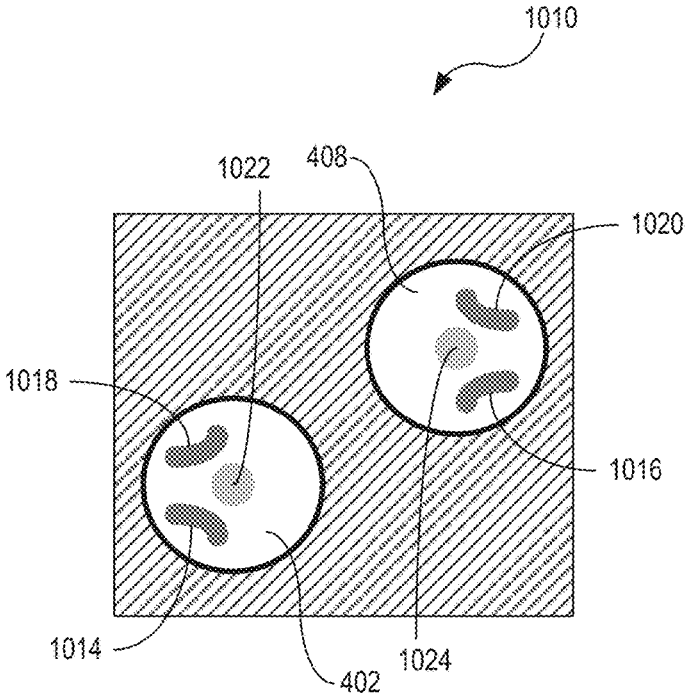
FIG. 10C is a cross-sectional top-view of an example of an implementation of two radiators of the IAiPWB (shown in FIGS. 10A and 10B) in accordance with the present disclosure.
Figure 10B:
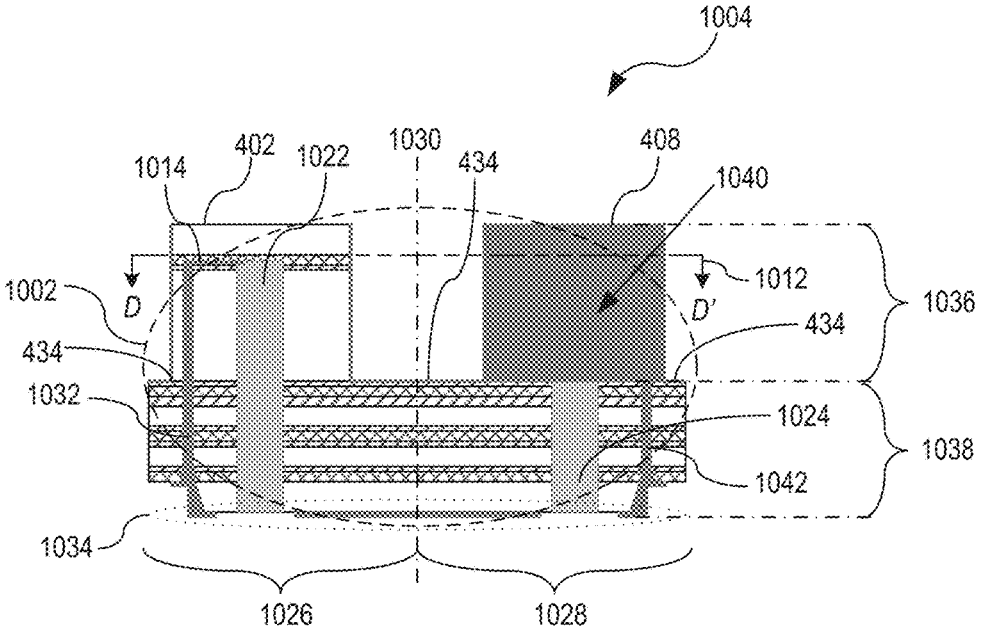
FIG. 10B is a cross-sectional front-view of an example of an implementation of the IAiPWB (shown in FIG. 10A) in accordance with the present disclosure.

Turning to FIGS. 10A-10C, varying views of an example of implementing the IAiPWB 1000 in a PWB 1002 are shown in accordance with the present disclosure. In FIG. 10A, a top-view of an example of an implementation of the IAiPWB 1000 in the PWB 1002 is shown in accordance with the present disclosure.

In FIG. 10B, a cross-sectional front-view of an example of an implementation of the IAiPWB 1000 on the PWB 1002 is shown in accordance with the present disclosure. FIG. 10B is a combined cross-sectional front-view of the cut-away portion 1004 along the cutting plane B-B' 1006 and part of the cutting plane C-C' 1008 both looking into the IAiPWB 1000 of FIG. 10A.

Turning to FIG. 10C, a cross-sectional top-view of an example of an implementation of two radiating elements 402 and 404 are shown in accordance with the present disclosure. In FIG. 10C, a cross-sectional top-view of the cut-away portion 1010 of the IAiPWB 1000 along the cutting plane D-D' 1012 looking into the top of the IAiPWB 1000 is shown. In this example, both the first radiating element 402 and the second radiating element 408 are shown including a first radiator 1014 and 1016, second radiator 1018 and 1020, and ground via 1022 and 1024, respectively, and as described earlier in relation to FIG. 4D.

Turning back to FIG. 10B, the cut-away portion 1004 is shown divided into a first portion 1026 of the PWB 1002 and a second portion 1028 of the PWB 1002 by a vertical center line 1030. The first portion 1026 is a part of the PWB 1002 that corresponds to the first radiating element 402 and the second portion 1028 is a part of the PWB 1002 that corresponds to the second radiating element 408. The first portion 1026 shows a cut-away portion of the PWB 1002 along the cutting plane B-B' 1006 while the second portion 1028 shows a cut-away portion of the PWB 1002 along the cutting plane C-C' 1008. As such, the first portion 1026 shows the first radiator 1014, first ground via 1022, and a first feed probe 1032 connecting the first radiator 1014 to a back-side 1034 of the PWB 1002. Unlike the first portion 1026, the second portion 1028 only shows part of the cut-away portion of the PWB 1002. Specifically, the second portion 1028 is also divided into a top portion 1036 and bottom portion 1038, where the top portion 1036 shows the neck 1040 of the second radiating element 408 and the bottom portion 1038 shows the cut-away portion of the PWB 1002 in the second portion 1028. The neck 1040 is shown as plated with the same conductive material as the top plate 434. The bottom portion 1038 shows a cut-away portion of the PWB 1002 that is along the cutting plane C-C' 1008 farther into the IAiPWB 1000 than the cut-away portion of the PWB 1002 along the cutting plane B-B' 1006. As such, the bottom portion 1038 shows the bottom portion of the second ground via 1024 and a first feed probe 1042 of the second radiating element 408.

In this example, the IAiPWB 1000 utilizes a split-via design to fabricate the IAiPWB 1000 with a signal path that transitions from a vertical plane of the vertical assembly of the brick module 604 to a horizontal plane of the horizontal assembly of the IAiPWB 1000. In general, the IAiPWB 1000 may be a "drop-in" replacement item for previously known AiPWBs that significantly improves the insertion losses (e.g., by at least 1 dB) and significantly reduces the assembly costs of fabrication. More specifically, the IAiPWB 1000 may be a front-end dual-polarized radiator transition that is more efficient (i.e., has less insertion loss) and significantly reduces the assembly costs of fabrication associated with known AiPWBs.

In this disclosure, the process of fabricating the IAiPWB 1000 includes a PWB stack up additive and subtractive process. It is appreciated by those of ordinary skill in the art that at present the term PWB and printed circuit board ("PCB") are generally interchangeably utilized. Traditionally, PWB or etched wiring board generally referred to a board that had no embedded components and a PCB generally referred to a board that mechanically supports and electrically connects electronic components utilizing conductive tracks or traces, pads, and other features etched from copper sheets laminated onto a non-conductive substrate. Moreover, populated PCBs with electronic components have been traditionally referred to as printed circuit assemblies ("PCAs"), printed circuit board assemblies, or PCB assemblies ("PCBAs"). However, at present the term PCB is generally utilized to refer to both bare and assembled boards and PWB has generally either fallen into disuse or is utilized interchangeably with PCBs. As such, for purposes of this disclosure, the terms PWB and PCB are considered interchangeable and cover both populated and unpopulated boards.

Figure 11:
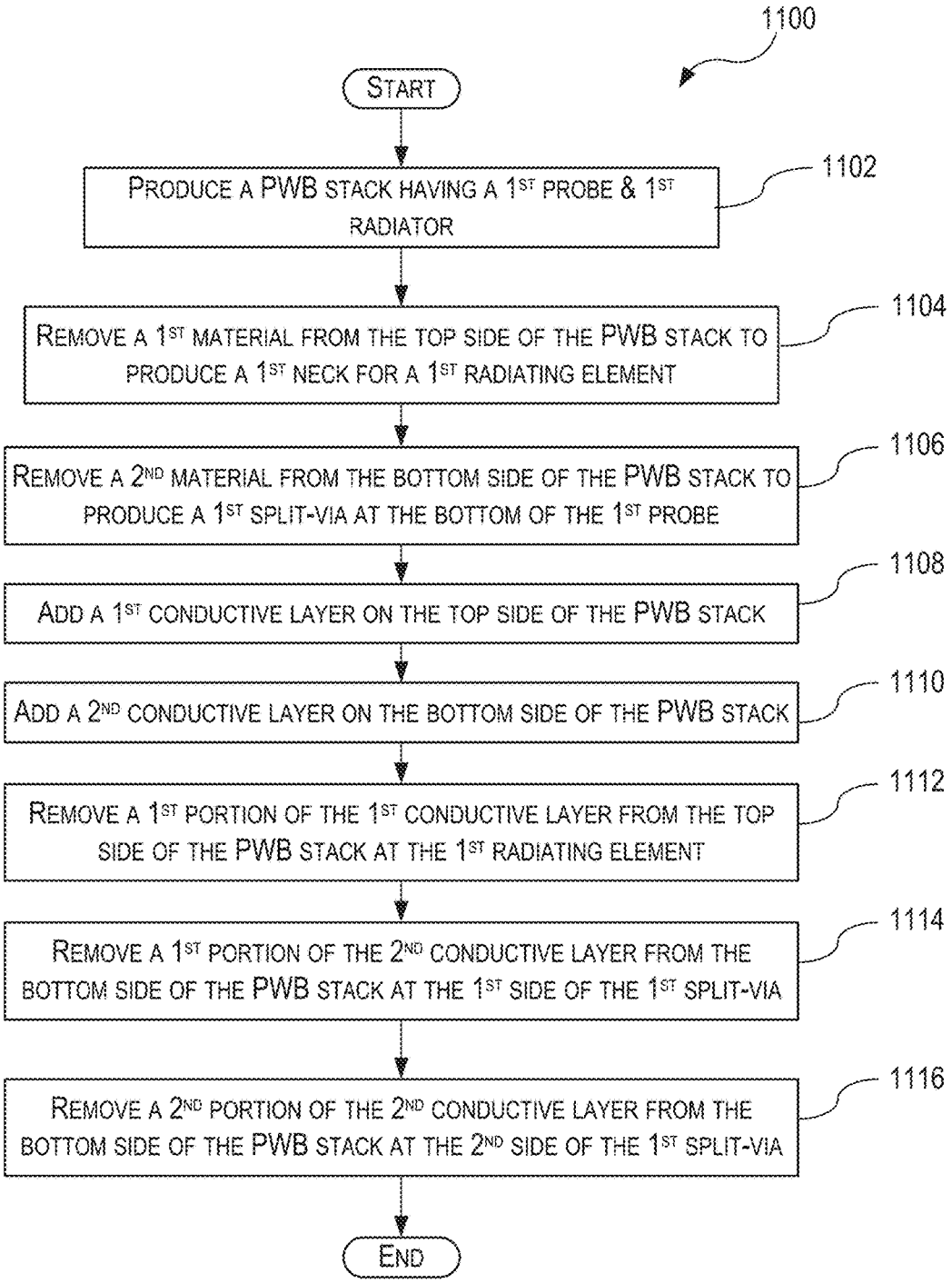
FIG. 11 is a flowchart of an example of an implementation of a method for fabricating the IAiPWB shown in FIGS. 4A-10C in accordance with the present disclosure.

More specifically, turning to FIG. 11, a flowchart is shown of an example of an implementation of a method 1100 for fabricating the IAiPWB, shown in FIGS. 4A-10C, in accordance with the present disclosure. The method starts by producing 1102 a PWB stack along a vertical central axis from a plurality of PWB layers. The PWB stack includes a top side, a bottom side, the first probe, and the first radiator; and the first probe includes a top portion and a bottom portion, where the top portion is in signal communication with the first radiator. The method then removes 1104 a first material from the top side of the PWB stack to produce a first neck for the first radiating element and removes 1106 a second material from the bottom side of the PWB stack to produce the first split-via at the bottom side of the first probe. The method then adds 1108 a first conductive layer on the top side of the PWB stack and adds 1110 a second conductive layer on the bottom side of the PWB stack. The method then removes 1112 a first portion of the first conductive layer from the top side of the PWB stack at the first radiating element and removes 1114 a first portion of the second conductive layer from the bottom side of the PWB stack from a first side of the first split-via. The method then removes 1116 a second portion of the second conductive layer from the bottom side of the PWB stack from a second side of the first split-via and ends.

In the case of two or more radiators in the first radiating element, as shown in FIG. 4F, the PWB stack may also include a second probe and a second radiator, where the second probe also includes a top portion and a bottom portion and the top portion is in signal communication with the second radiator (as shown in FIG. 4F). In this example, the first radiator 486 and second radiator 488 are in signal communication with the first probe and second probe, respectively.

In the case of two or more radiating elements in the IAiPWB, as shown in FIGS. 4A-10C, the PWB stack may also include at least a second radiating element. As an example, the IAiPWB 400 includes at least first radiating element 402 and second radiating element 404. In this example, the second radiating element 404 may also include a first radiator, second radiator, first probe, and second probe, where the first radiator is in signal communication with the first probe and the second radiator is in signal communication with the second probe. In this example, the IAiPWB 400 would include at least four radiators and four probes.

In this example, the method 1100 would include also include removing the first material from the top side of the PWB stack to produce a second neck for the second radiating element and removing the second material from the bottom side of the PWB stack to produce a first split-via at the bottom side of the first probe of the second radiating element. The method 1100 may also include removing the second material from the bottom side of the PWB stack to produce a second split-via at the bottom side of the second probe of the first radiating element and a second split-via at the bottom side of the second probe of the second radiating element. In this example, the method 1100 also removes a second portion of the first conductive layer from the top side of the PWB stack at the second radiating element and removes a first portion of the second conductive layer from the bottom side of the PWB stack from a first side of the second split-via of the first probe, a first side of the first and second split-vias of the second probe. The method 1100 then also removes a second portion of the second conductive layer from the bottom side of the PWB stack from a second side of the second split-via for the first probe and second side of the first and second split-vias of the second probe.

Figure 12:
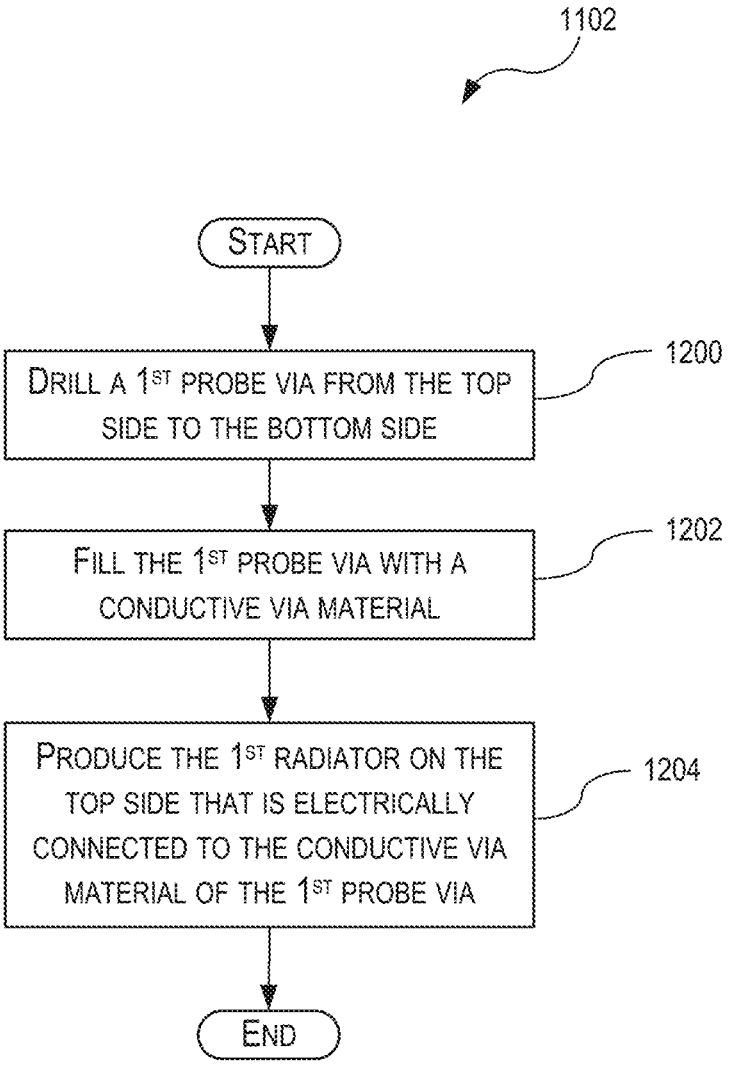
FIG. 12 is a flowchart of an example of an implementation of sub-method of the producing the PWB stack step of the method shown in FIG. 11 in accordance with the present disclosure.

In FIG. 12, a flowchart is shown of an example of an implementation of sub-method of the producing 1102 the PWB stack step of the method 1100 in accordance with the present disclosure. Once the PWB stack is fabricated with a plurality of different material layers, the step of producing 1102 the PWB stack further includes: drilling 1200 a first probe via from the top side of the PWB stack to the bottom side of the PWB stack at the first radiating element; filling 1202 the first probe via with a conductive via material; and producing 1204 the first radiator on the top side of the first radiating element, where the first radiator is electrically connected to the conductive via material of the first probe via. This producing step 1102 may also include drilling a second first probe via from the top side of the PWB stack to the bottom side of the PWB stack at the second radiating element; filling the first probe via with a conductive via material; and producing the first radiator on the top side of the second radiating element, where the first radiator is electrically connected to the conductive via material of the first probe via. It is appreciated by those of ordinary skill in the art that the same process may be repeated (or performed simultaneously) for a second radiator and second probe within the first and second radiating elements.

Figure 13A:
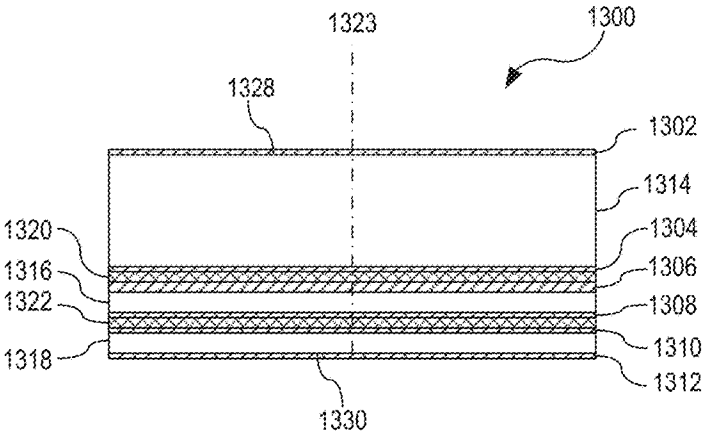
FIG. 13A is a sectional side-view is shown of an example of an implementation of an initial PWB stack in accordance with the present disclosure.

In FIGS. 13A-13D, sectional side-views are shown of an example of an implementation of producing the PWB stack as described by the method step 1102 shown in FIG. 12. Turning to FIG. 13A, a sectional side-view is shown of an example of an implementation of an initial PWB stack 1300 in accordance with the present disclosure. In this example, the initial PWB stack 1300 includes a plurality of material layers that, in this example, include six (6) conductive layers 1302, 1304, 1306, 1308, 1310, and 1312, three (3) dielectric core layers 1314, 1316, and 1318, and two (2) pre-impregnated ("pre-preg") layers 1320 and 1322. As used herein, the term pre-preg refers to a fibrous material pre-impregnated with a synthetic resin. The initial PWB stack 1300 is fabricated along a vertical central axis 1323.

It is appreciated by those of ordinary skill in the art that in PWB (or PCB) design, PWB stacks are produced by laminating multiple layers of material together where generally a PWB layer includes a multi-layer structure having a dielectric core layer (generally known as a "core") sandwiched between two conductive layers. The cores are generally "hard" dielectric material such as, for example, a Flame Retardant 4 ("FR-4") glass-reinforced epoxy laminate composite material of woven fiberglass cloth with an epoxy resin binder that is flame resistant. The two conductive layers are usually layers of copper foil laminated to both sides of a core. It is appreciated by those of ordinary skill that the term "core" is sometimes utilized to describe the complete structure of a core sandwiched between two copper foil laminated conductive layers, however, in this disclosure the term "core" shall generally be utilized to describe the core material (i.e., FR-4) between the copper foil laminates. As an example, the FR-4 material may be produced by Advanced Circuits of Aurora, Colo.

Generally, the pre-preg layers are layers of fiber weave impregnated with resin bonding agent. However, unlike the core layers, the pre-preg layers are generally pre-dried but not hardened so that if heated, the material of the pre-preg flows and sticks to other layers. As such, generally, pre-preg layers are utilized to stick other layers together. In this example, the conductive layers 1302, 1304, 1306, 1308, 1310, and 1312 may be copper foil having approximately 0.7 mils of thickness.

In this example, the first core 1314 is shown sandwiched between the first and second conductive layers 1302 and 1304. The second core 1318 is shown sandwiched between the third and fourth conductive layers 1306 and 1308 and the third core 1318 is shown sandwiched between the fifth and sixth conductive layers 1310 and 1312. Moreover, in this example, the second conductive layer 1304 is attached to the third conductive layer 1306 with the first pre-preg layer 1320 and the fourth conductive layer 1308 is attached to the fifth conductive layer 1310 with the second pre-preg layer 1322.

Figure 13B:
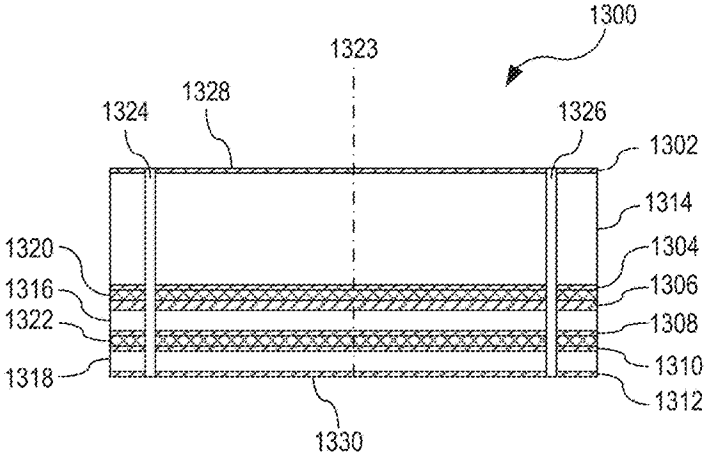
FIG. 13B is a sectional side-view is shown of an example of an implementation of producing a first probe via and second probe via through the initial PWB stack in accordance with the present disclosure.

In FIG. 13B, a sectional side-view is shown of an example of an implementation of producing a first probe via 1324 and second probe 1326 via through the initial PWB stack 1300 in accordance with the present disclosure. The first and second probe vias 1324 and 1326 are produced by drilling 1200 the first and second probe vias 1324 and 1326 from a top side 1328 of the initial PWB stack 1300 to a bottom side 1330 of the initial PWB stack 1300. The first probe via 1324 corresponds to the first probe and includes a top portion and a bottom portion and the second probe via 1326 corresponds to the second probe and also includes a top portion and a bottom portion. In this example, the drilling may include drilling with mechanical bits or laser-drilling.

Figure 13C:
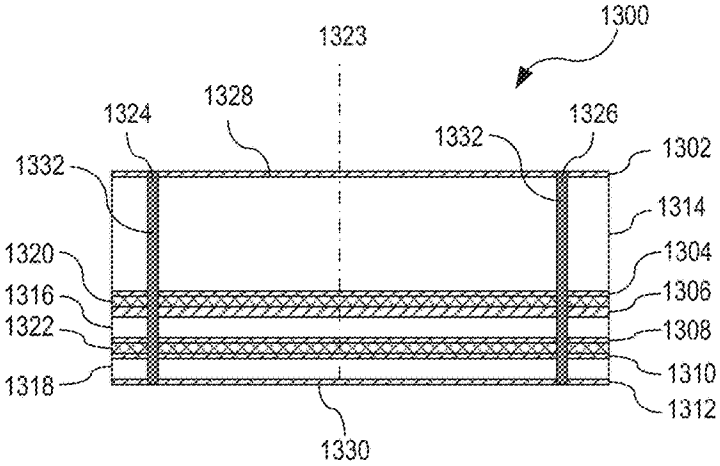
FIG. 13C is a sectional side-view is shown of the first probe via and second probe via being filled with a conductive material in accordance with the present disclosure.

In FIG. 13C, a sectional side-view is shown of the first probe via 1324 and second probe 1326 via being filled 1202 with a conductive material 1332 in accordance with the present disclosure. In this example, the conductive material 1332 may be a conductive via plug paste or conductive filling material such as, for example, CB100® produced by DuPont of Research Triangle Park, N.C.

Figure 13D:
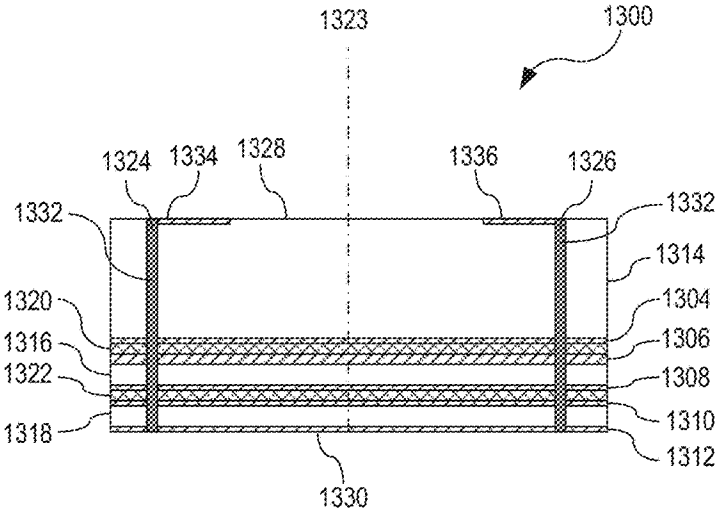
FIG. 13D is a sectional side-view is shown of an example of implementation of producing a first radiator and second radiator in accordance with the present disclosure.

In FIG. 13D, a sectional side-view is shown of an example of implementation of producing 1204 a first radiator 1334 and second radiator 1336 in accordance with the present disclosure. In this example, the first and second radiator 1334 and 1336 may be produced by etching away the first conductive layer 1302 from the PWB stack 1300.

Figure 13F:
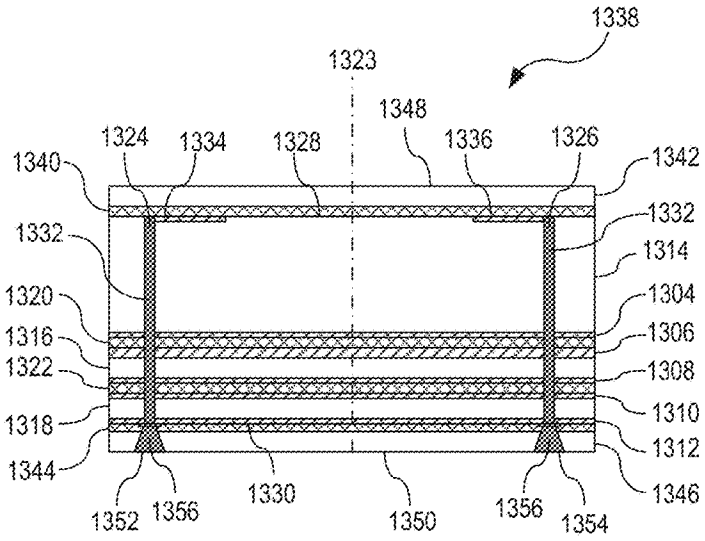
FIG. 13F is the sectional side-view of FIG. 13E showing that the bottom surface is shown drilled to form a first connection via and second connection that is filled with additional conductive material that electrically connects the first connection via to the conductive material of the first probe via and the second probe via in accordance with the present disclosure.
Figure 13E:
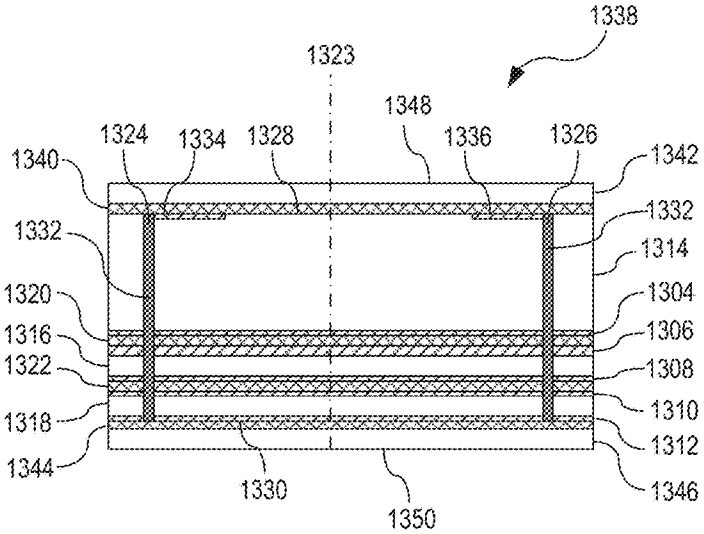
FIG. 13E is a sectional side-view is shown of an example of implementation of producing the PWB stack from the initial PWB stack in accordance with the present disclosure.

In FIG. 13E, a sectional side-view is shown of an example of implementation of producing the PWB stack 1338 from the initial PWB stack 1300 in accordance with the present disclosure. In this example, a fourth pre-preg layer 1344 and fifth dielectric core layer 1346 are attached to the top side 1328 of the initial PWB stack 1300 and a third pre-preg layer 1340 and fourth dielectric core layer 1342 are attached to the top side 1328 of the initial PWB stack 1300 resulting in the PWB stack 1338 having a top surface 1348 and bottom surface 1350.

In FIG. 13F, the bottom surface 1350 is shown drilled to form a first connection via 1352 and second connection 1354 that is filled with additional conductive material 1356 that electrically connects the first connection via 1352 to the conductive material 1332 of the first probe via 1324 and the second probe via 1326. The result of this process produces the PWB stack 1338 for use in producing the IAiPWB described in the method 1100 of FIG. 11. In these examples, it is appreciated that for the ease of illustration the optional grounding vias 492, 512, 1022, or 1024 of FIG. 4F, 5, 10B, or 10C are not shown in FIGS. 13A-13I, however the grounding vias may optionally be present to improve the electrical performance of the radiating elements.

Figure 13G:
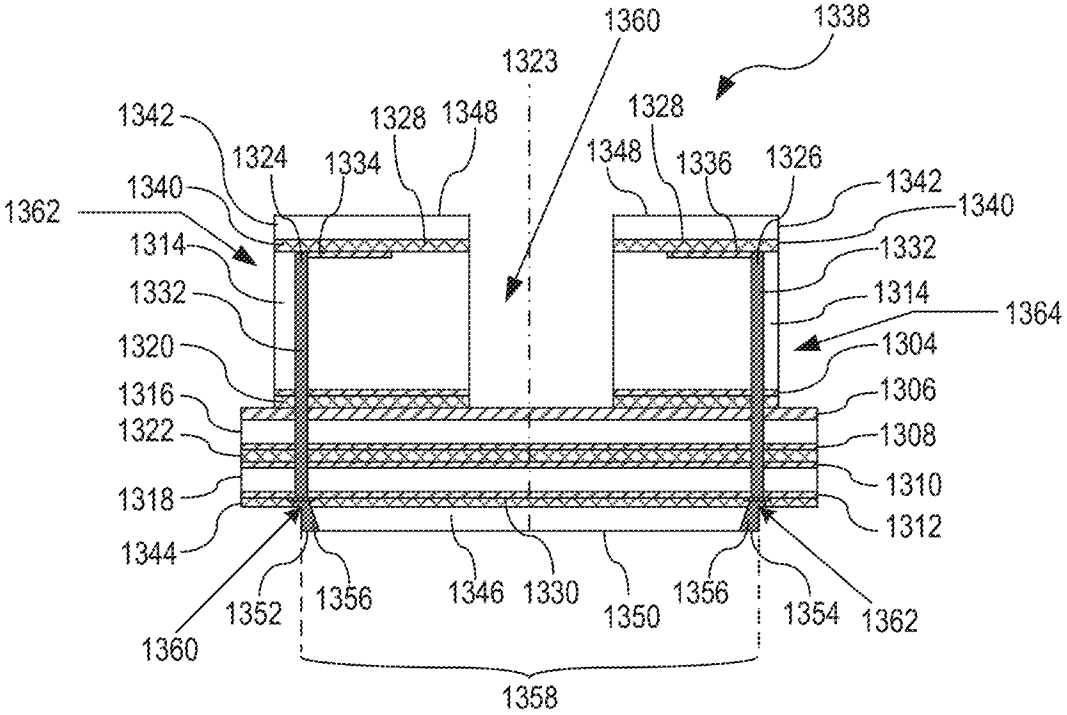
FIG. 13G is a first material is removed from the top surface of the PWB stack and a second material is removed from the bottom surface in accordance with the present disclosure.

In FIG. 13G, a first material is removed from the top surface 1348 of the PWB stack 1338 and a second material is removed from the bottom surface 1350 in accordance with the present disclosure. In this example, the removed first material results in producing a first neck 1358 for the first radiating element and a second neck for the second radiating element. Additionally, the removed second material from the bottom surface 1350 results in producing the first split via 1348 from the first connection via 1352 and the second split via 1350 from the second connection via 1354.

In this example, the first portion of the first material may be removed from the top surface 1348 of the PWB stack 1338 utilizing a routing or etching process. The removal of the first material may be performed with a controlled-depth route from the top surface 1348 to a back-shorted metallization layer at third conductive layer 1306. Moreover, the removal of the second material may be performed with a controlled-depth route from the bottom surface 1350 and partially slicing through one or more of the solid first connection via 1352 and second connection via 1354 to form a ledge 1358 that includes a first ledge at the first connection via 1352 and second ledge at the second connection via 1354 in one or more carve-out regions. As an example, the split-vias 1360 and 1362 may be cut substantially in half with a high-speed router or cutting device to form a contact portion on the side of both the first and second connection vias 1352 and 1354. If the first and second connection vias 1352 and 1354 are elongated vias, both a top and side portion of the split-vias 1360 and 1362 may be utilized as wire bonding sites.

In this example, the controlled-depth route from the top surface 1348 partially slicing through the first material produces a first cut-out region 1360, second cut-out region 1362, and third cut-out region 1364. In these examples, it is appreciated that the first material includes the first dielectric core layer 1314, second conductive layer 1304, first pre-preg layer 1320, fourth dielectric core layer 1342, and third pre-preg layer 1340. Moreover, the second material includes fifth dielectric core layer 1342.

Figure 13H:
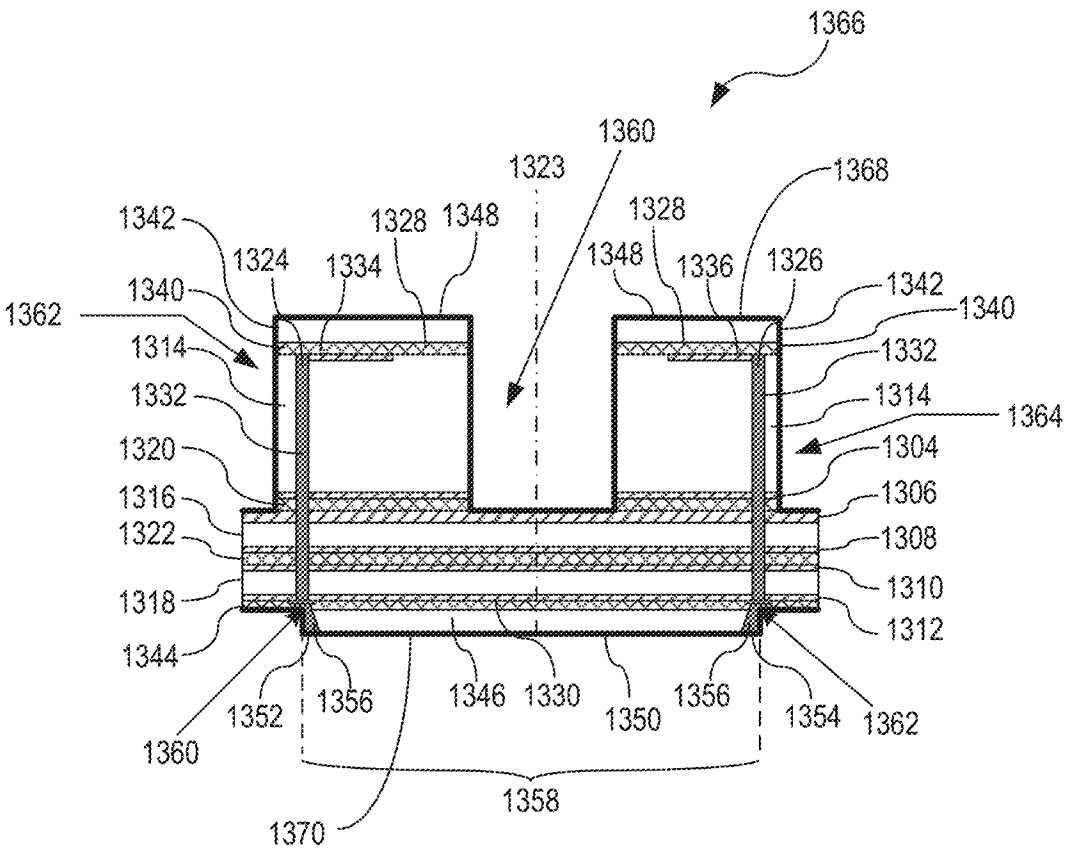
FIG. 13H is a sectional side-view is shown of an example of an implementation of a combination of the PWB stack and a first conductive layer and second conductive layer in accordance with the present disclosure.
Figure 13I:
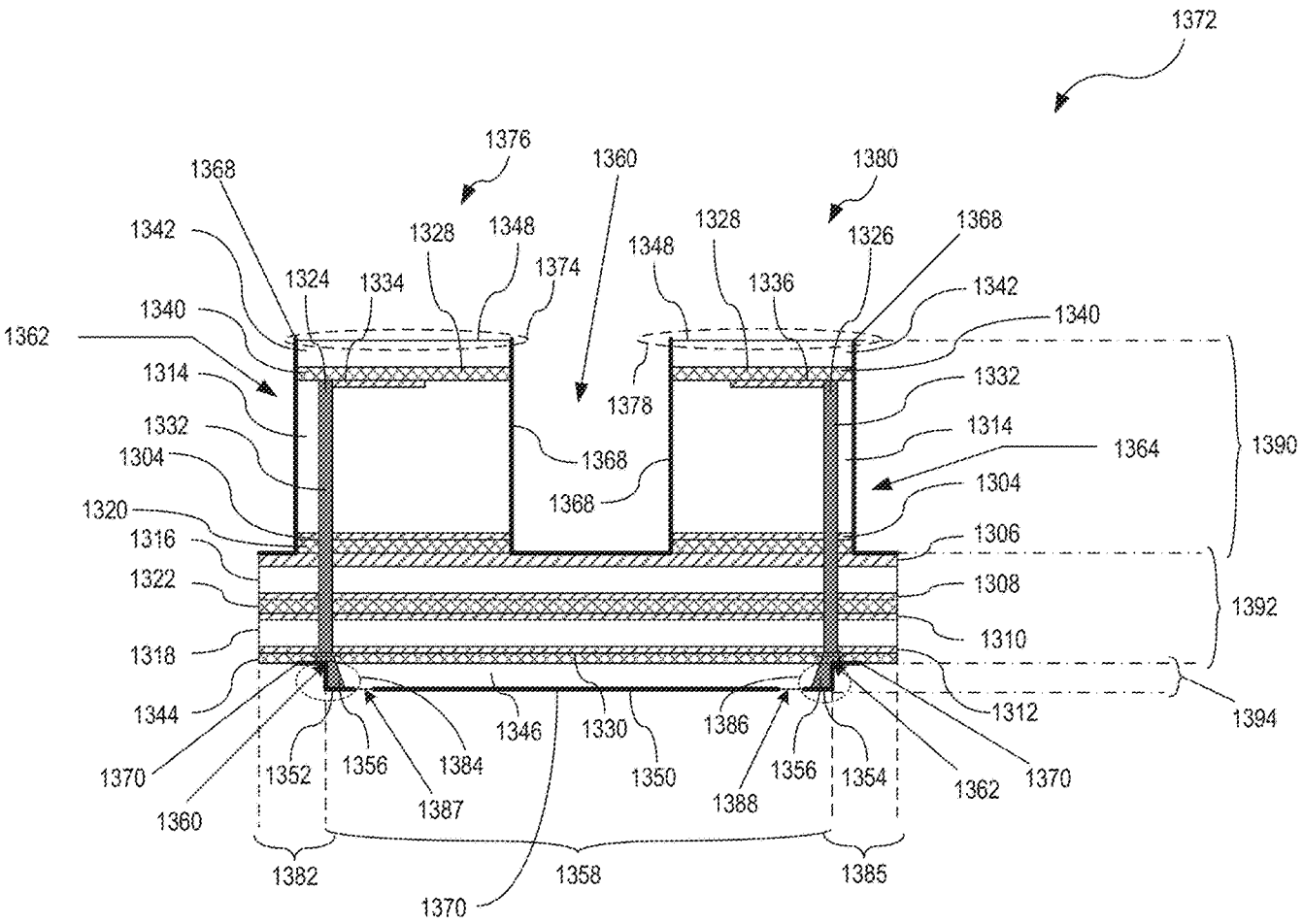
FIG. 13I is a second side-view of an example of an implementation of the IAiPWB is shown in accordance with the present disclosure.

Turning to FIG. 13H, a sectional side-view is shown of an example of an implementation of a combination 1366 of the PWB stack 1338 and a first conductive layer 1368 and second conductive layer 1370 in accordance with the present disclosure. In FIG. 13I, a second side-view of an example of an implementation of the IAiPWB 1372 is shown in accordance with the present disclosure. In this example, a first portion 1374 of the first conductive layer 1368 has been removed from the top surface 1348 of the PWB stack 1338 at the first radiating element 1376 and a second portion 1378 of the first conductive layer 1368 has been removed from the top surface 1348 of the PWB stack 1338 at the second radiating element 1380. Additionally, a first portion 1382 of the second conductive layer 1370 at a first side of the first split-via 1384 and a first portion 1385 of the second conductive layer 1370 from the bottom surface 1350 at a first side of the second split-via 1386 has been removed from the bottom surface 1350 of the PWB stack 1338. Moreover, a second portion 1387 of the second conductive layer 1370 has been removed from the bottom surface 1350 of the PWB stack 1338 at a second side of the first split-via 1384 and a second portion 1388 of the second conductive layer 1370 has been removed from the bottom surface 1350 of the PWB stack 1338 at a second side of the second split-via 1386.

In these examples, the height 1390 of the neck of the radiating elements is approximately 65.1 mils, the diameters of the radiating elements are approximately 105 mils, the width 1392 of the base of IAiPWB 1372 is approximately 13.1 mils, and the ledge height 1394 is approximately 9.4 mils. In this example, the conductive layers 1304, 1306, 1308, 1310, and 1312 may be copper foil having a thickness of approximately 0.7 mils, the pre-preg layers 1340, 1320, 1322, and 1344 may have thicknesses that vary from 3 to 4 mils. The dielectric core layers 1342, 1314, 1316, 1318, and 1346 may have thicknesses that vary from 8 to 44 mils, where the dielectric core layer 1414 in the radiating elements may be approximately 44 mils and the fourth dielectric core layer 1342 covering the radiators 1334 and 1336 may be approximately 12 mils. The thickness of the radiators 1334 and 1336 may be approximately 1.4 mils and may protrude out from the conductive layer 1306 by approximately 47 mils. The diameter of the first and second probe vias 1324 and 1326 may be approximately 7 mils and the bottom thickness of the split-vias 1384 and 1386 may be approximately 6 mils.

Figure 14:
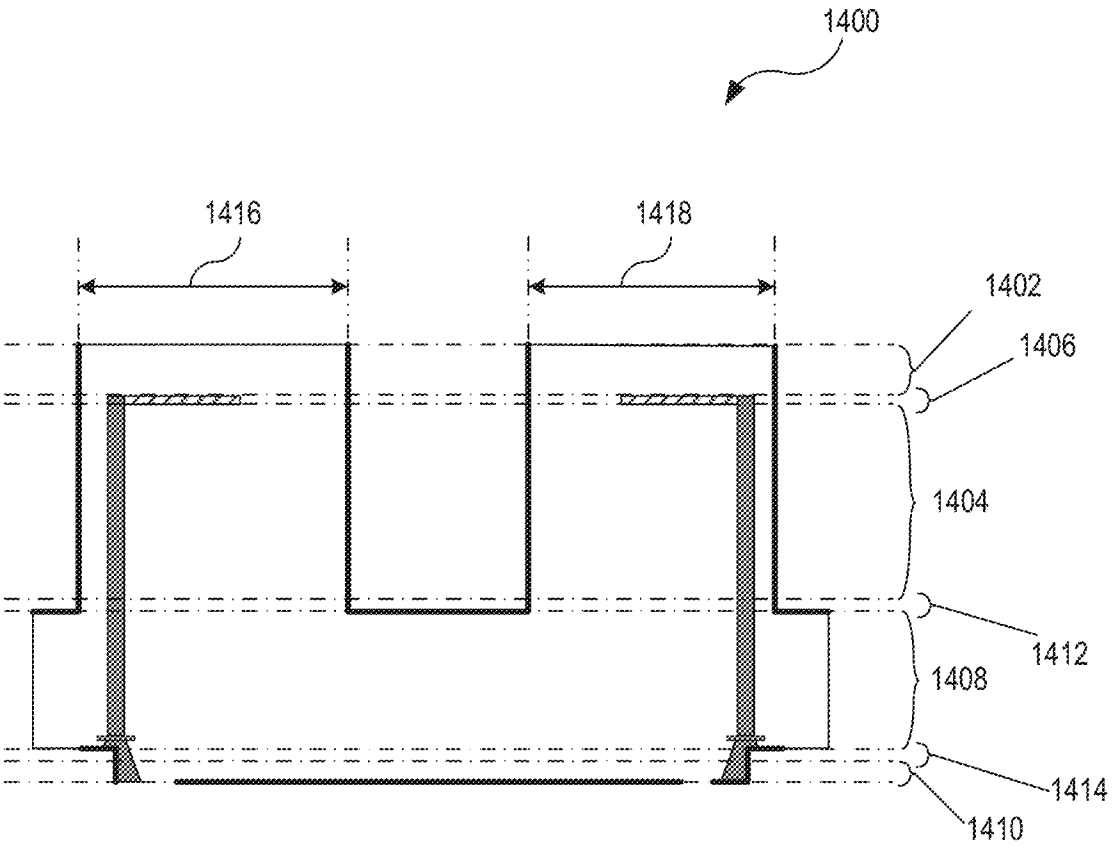
FIG. 14 is a partial side-view of an example of another implementation of the IAiPWB in accordance with the present disclosure.

FIG. 14 is a partial side-view of an example of another implementation of the IAiPWB 1400 in accordance with the present disclosure. As compared to the examples shown in FIGS. 13A-13I, FIG. 14 shows example values for the stack up of the PWB stack of the IAiPWB 1400. In this example, the probe overlay layer 1402 may be approximately 12 mils, a first core layer 1404 may be approximately 44 mils, and a pre-preg layer 1406 between the probe overlay layer 1402 and first core layer may be approximately 4 mils. A second core layer 1408 may be approximately 8 mils and a third core layer 1410 may be approximately 8 mils. The first core layer 1404 and second core layer 1408 may be attached by a second pre-preg layer 1412 that may be approximately 4 mils. The second core layer 1408 may third core layer 1410 may be attached by a third pre-preg layer 1414 that may be approximately 3 mils. The diameter 1416 of the first radiating element and the diameter 1418 of the second radiating element may both be approximately 0.105 inches.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. An antenna integrated printed wiring board comprising:

a printed wiring board having a bottom surface, wherein the printed wiring board includes a ledge at the bottom surface;

a first radiating element having a first radiator and a first probe in signal communication with the first radiator, wherein the first radiating element is integrated into the printed wiring board; and a first split-via in signal communication with the first probe, wherein a first portion of the first split-via is integrated into the printed wiring board at the bottom surface, and wherein a second portion of the first split-via is integrated into the ledge.

2. The antenna integrated printed wiring board of claim 1, further comprising a second split-via, wherein the first radiating element further includes a second radiator and a second probe in signal communication with the second radiator, wherein the second radiator is integrated into the printed wiring board, and wherein the second split-via is in signal communication with the second probe.

3. The antenna integrated printed wiring board of claim 2, wherein the first radiating element further includes a ground via that is proximate to the first radiator and the second radiator, wherein the ground via is integrated into the printed wiring board.

4. The antenna integrated printed wiring board of claim 2, wherein a first portion of the second split-via is integrated into the printed wiring board at the bottom surface.

5. The antenna integrated printed wiring board of claim 4, wherein the first radiator is arranged along a first plane having a first orientation, wherein the second portion of the first split-via is integrated into the ledge along a second plane having a second orientation, and wherein the second orientation is approximately perpendicular to the first orientation.

6. The antenna integrated printed wiring board of claim 4, wherein a second portion of the second split-via is integrated into the ledge.

7. The antenna integrated printed wiring board of claim 6, wherein the first radiator and second radiator are arranged along a first plane having a first orientation, wherein the second portion of the first split-via is integrated into the ledge along a second plane having a second orientation, wherein the second portion of the second split-via is integrated into the ledge along the second plane having a second orientation, and wherein the second orientation is approximately perpendicular to the first orientation.

8. The antenna integrated printed wiring board of claim 1, further including a neck of plated conductive material around the first radiating element.

9. The antenna integrated printed wiring board of claim 8, wherein the neck of plated conductive material forms a cylindrical waveguide, rectangular waveguide, square waveguide, or elliptical waveguide around the first radiating element.

10. The antenna integrated printed wiring board of claim 1, further comprising:

a second radiating element having a second radiator and a second probe in signal communication with the second radiator, wherein the second radiating element is also integrated into the printed wiring board; and a second split-via in signal communication with the second probe, wherein a first portion of the second split-via is integrated into the printed wiring board at the bottom surface.

11. The antenna integrated printed wiring board of claim 10, further comprising:

a third split-via; and a fourth split-via, wherein the first radiating element further includes a third radiator and a third probe in signal communication with the third radiator, wherein the third radiator is also integrated into the printed wiring board, wherein the second radiating element further includes a fourth radiator and a fourth probe in signal communication with the fourth radiator, wherein the fourth radiator is also integrated into the printed wiring board, wherein the third split-via is in signal communication with the third probe, wherein a first portion of the third split-via is integrated into the printed wiring board at the bottom surface, and wherein the fourth split-via is in signal communication with the fourth probe, wherein a first portion of the fourth split-via is integrated into the printed wiring board at the bottom surface.

12. A method of fabricating an antenna integrated printed wiring board on a printed wiring board, the method comprising:

producing a printed wiring board stack along a vertical central axis from a plurality of printed wiring board layers, wherein the printed wiring board stack has a top surface, a bottom surface, a first probe, and a first radiator, wherein the first probe has a top portion and a bottom portion, and wherein the top portion of the first probe is in signal communication with the first radiator;

removing a first material from the top surface of the printed wiring board stack to produce a first neck for a first radiating element;

removing a second material from the bottom surface of the printed wiring board stack to produce a first split-via at the bottom surface of the first probe, wherein a portion of the first split-via is integrated into a ledge at the bottom surface of the printed wiring board;

adding a first conductive layer on the top surface of the printed wiring board stack;

adding a second conductive layer on the bottom surface of the printed wiring board stack;

removing a first portion of the first conductive layer from the top surface of the printed wiring board stack at the first radiating element;

removing a first portion of the second conductive layer from the bottom surface of the printed wiring board stack at a first side of the first split-via; and removing a second portion of the second conductive layer from the bottom surface of the printed wiring board stack at a second side of the first split-via.

13. The method of claim 12, wherein removing the first portion of the first conductive layer from the top surface of the printed wiring board stack at the first radiating element includes routing or etching the first portion of the first conductive layer.

14. The method of claim 13, wherein the first conductive layer and second conductive layer includes copper.

15. The method of claim 12, further comprising:

removing the first material from the top surface of the printed wiring board stack to produce a second neck for a second radiating element;

removing the second material from bottom surface of the printed wiring board stack to produce a second split-via at the bottom surface of a second probe of the printed wiring board stack;

removing a second portion of the first conductive layer from the top surface of the printed wiring board stack at the second radiating element;

removing a second portion of the second conductive layer from the bottom surface of the printed wiring board stack from a first side of the second split-via; and removing a second portion of the second conductive layer from the bottom surface of the printed wiring board stack from a second side of the second split-via.

16. The method of claim 15, wherein producing the printed wiring board stack includes producing an initial printed wiring board stack including three dielectric core layers, wherein each core layer has a varying thickness and includes two pre-impregnated layers.

17. The method of claim 16, wherein producing the printed wiring board stack further includes:

drilling a first probe via from the top surface to the bottom surface;

filling the first probe via with a conductive via material; and producing the first radiator on the top surface that is electrically connected to the conductive via material of the first probe via.

18. The method of claim 17, wherein producing the printed wiring board stack further includes adding a first dielectric layer on the top surface of the printed wiring board stack to cover the first radiator.

19. The method of claim 18, wherein producing the printed wiring board stack further includes:

adding a second dielectric layer on the bottom surface of the printed wiring board stack;

drilling a first bottom via through the second dielectric layer to the bottom portion of the first probe; and filling the first bottom via with the conductive via material.

20. The method of claim 18, wherein removing the second material from the bottom surface of the printed wiring board stack to produce the first split-via at the bottom surface of the first probe includes performing a controlled-depth route from the bottom surface and partially slicing through the bottom portion of the first probe to form the first split-via.

21. The method of claim 17, wherein the conductive via material includes copper.

22. The method of claim 17, wherein removing the first material from the top surface of the printed wiring board stack to produce the first neck for the first radiating element includes performing a controlled-depth route from the top surface to a back-shorted metallization layer, wherein the controlled-depth route from the top surface to the back-shorted metallization layer provides one or more carve-out regions.

* * * * *